US007931081B2

(12) United States Patent
Sponchia

(10) Patent No.: US 7,931,081 B2
(45) Date of Patent: Apr. 26, 2011

(54) SYSTEMS, METHODS AND APPARATUSES FOR MONITORING AND RECOVERY OF PETROLEUM FROM EARTH FORMATIONS

(75) Inventor: Barton Sponchia, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 178 days.

(21) Appl. No.: 12/140,779

(22) Filed: Jun. 17, 2008

(65) Prior Publication Data

US 2009/0283263 A1 Nov. 19, 2009

Related U.S. Application Data

(60) Provisional application No. 61/052,919, filed on May 13, 2008.

(51) Int. Cl.
*E21B 47/026* (2006.01)
*E21B 47/01* (2006.01)
*E21B 47/12* (2006.01)

(52) U.S. Cl. ..... 166/250.11; 166/247; 166/248; 166/250.01; 166/250.16; 166/254.2

(58) Field of Classification Search ..... None
See application file for complete search history.

(56) References Cited

U.S. PATENT DOCUMENTS

| | | | |
|---|---|---|---|
| 1,362,552 | A | 12/1920 | Alexander et al. |
| 1,649,524 | A | 11/1927 | Hammond |
| 1,915,867 | A | 6/1933 | Penick |
| 1,984,741 | A | 12/1934 | Harrington |
| 2,089,477 | A | 8/1937 | Halbert |
| 2,119,563 | A | 6/1938 | Wells |
| 2,214,064 | A | 9/1940 | Niles |
| 2,257,523 | A | 9/1941 | Combs |
| 2,391,609 | A | 12/1945 | Wright |
| 2,412,841 | A | 12/1946 | Spangler |
| 2,762,437 | A | 9/1956 | Egan et al. |

(Continued)

FOREIGN PATENT DOCUMENTS

CN 1385594 12/2002

(Continued)

OTHER PUBLICATIONS

Henry Restarick. "Horizontal Completion Options in Reservoirs with Sand Problems". SPE 29831. Mar. 11-14, 1995. pp. 545-560.

(Continued)

*Primary Examiner* — Zakiya W. Bates
(74) *Attorney, Agent, or Firm* — Cantor Colburn LLP

(57) ABSTRACT

A system for monitoring a location of a borehole for production of petroleum from an earth formation is provided. The system includes: an assembly including at least one of an injection conduit for injecting a thermal source into the formation and a production conduit for recovering material including the petroleum from the formation; a guide conduit attached to at least a portion of the at least one of the injection conduit and the production conduit, the guide conduit extending in a direction at least substantially parallel to the at least one of the injection conduit and the production conduit; and a detection source conduit insertable through the guide conduit and configured to dispose therein a detection source for detecting a location of the assembly in the formation. A method of monitoring a location of a borehole for production of petroleum from an earth formation is also provided.

18 Claims, 17 Drawing Sheets

U.S. PATENT DOCUMENTS

| | | | |
|---|---|---|---|
| 2,804,926 | A | 9/1957 | Zublin |
| 2,810,352 | A | 10/1957 | Tumlison |
| 2,814,947 | A | 12/1957 | Stegemeier et al. |
| 2,942,668 | A | 6/1960 | Maly et al. |
| 2,945,541 | A | 7/1960 | Maly et al. |
| 3,103,789 | A | 9/1963 | McDuff |
| 3,240,274 | A | 3/1966 | Solum |
| 3,273,641 | A | 9/1966 | Bourne |
| 3,302,408 | A | 2/1967 | Schmid |
| 3,322,199 | A | 5/1967 | Van Note, Jr. |
| 3,326,291 | A | 6/1967 | Zandmer |
| 3,385,367 | A | 5/1968 | Kollsman |
| 3,386,508 | A | 6/1968 | Bielstein et al. |
| 3,419,089 | A | 12/1968 | Venghiattis |
| 3,451,477 | A | 6/1969 | Kelley |
| RE27,252 | E | 12/1971 | Sklar et al. |
| 3,675,714 | A | 7/1972 | Thompson |
| 3,692,064 | A | 9/1972 | Hohnerlein et al. |
| 3,739,845 | A | 6/1973 | Berry et al. |
| 3,791,444 | A | 2/1974 | Hickey |
| 3,876,471 | A | 4/1975 | Jones |
| 3,918,523 | A | 11/1975 | Stuber |
| 3,951,338 | A | 4/1976 | Genna |
| 3,975,651 | A | 8/1976 | Griffiths |
| 4,153,757 | A | 5/1979 | Clark, III |
| 4,173,255 | A | 11/1979 | Kramer |
| 4,180,132 | A | 12/1979 | Young |
| 4,186,100 | A | 1/1980 | Mott |
| 4,187,909 | A | 2/1980 | Erbstoesser |
| 4,248,302 | A | 2/1981 | Churchman |
| 4,250,907 | A | 2/1981 | Struckman et al. |
| 4,257,650 | A | 3/1981 | Allen |
| 4,265,485 | A | 5/1981 | Boxerman et al. |
| 4,283,088 | A | 8/1981 | Tabakov et al. |
| 4,287,952 | A | 9/1981 | Erbstoesser |
| 4,390,067 | A | 6/1983 | Willman |
| 4,415,205 | A | 11/1983 | Rehm et al. |
| 4,434,849 | A | 3/1984 | Allen |
| 4,463,988 | A | 8/1984 | Bouck et al. |
| 4,491,186 | A | 1/1985 | Alder |
| 4,497,714 | A | 2/1985 | Harris |
| 4,552,218 | A | 11/1985 | Ross et al. |
| 4,572,295 | A | 2/1986 | Walley |
| 4,614,303 | A | 9/1986 | Moseley, Jr. et al. |
| 4,649,996 | A | 3/1987 | Kojicic et al. |
| 4,821,800 | A | 4/1989 | Scott et al. |
| 4,856,590 | A | 8/1989 | Caillier |
| 4,917,183 | A | 4/1990 | Gaidry et al. |
| 4,944,349 | A | 7/1990 | Von Gonten, Jr. |
| 4,974,674 | A | 12/1990 | Wells |
| 4,998,585 | A | 3/1991 | Newcomer et al. |
| 5,004,049 | A | 4/1991 | Arterbury |
| 5,016,710 | A | 5/1991 | Renard et al. |
| 5,040,283 | A | 8/1991 | Pelgrom |
| 5,060,737 | A | 10/1991 | Mohn |
| 5,107,927 | A | 4/1992 | Whiteley et al. |
| 5,132,903 | A | 7/1992 | Sinclair |
| 5,156,811 | A | 10/1992 | White |
| 5,217,076 | A | 6/1993 | Masek |
| 5,333,684 | A | 8/1994 | Walter et al. |
| 5,337,821 | A | 8/1994 | Peterson |
| 5,339,895 | A | 8/1994 | Arterbury et al. |
| 5,339,897 | A | 8/1994 | Leaute |
| 5,355,956 | A | 10/1994 | Restarick |
| 5,377,750 | A | 1/1995 | Arterbury et al. |
| 5,381,864 | A | 1/1995 | Nguyen et al. |
| 5,384,046 | A | 1/1995 | Lotter et al. |
| 5,431,346 | A | 7/1995 | Sinaisky |
| 5,435,393 | A | 7/1995 | Brekke et al. |
| 5,435,395 | A | 7/1995 | Connell |
| 5,439,966 | A | 8/1995 | Graham et al. |
| 5,511,616 | A | 4/1996 | Bert |
| 5,551,513 | A | 9/1996 | Surles et al. |
| 5,586,213 | A | 12/1996 | Bridges et al. |
| 5,597,042 | A | 1/1997 | Tubel et al. |
| 5,609,204 | A | 3/1997 | Rebardi et al. |
| 5,673,751 | A | 10/1997 | Head et al. |
| 5,803,179 | A | 9/1998 | Echols et al. |
| 5,829,520 | A | 11/1998 | Johnson |
| 5,831,156 | A | 11/1998 | Mullins |
| 5,839,508 | A | 11/1998 | Tubel et al. |
| 5,873,410 | A | 2/1999 | Iato et al. |
| 5,881,809 | A | 3/1999 | Gillespie et al. |
| 5,896,928 | A | 4/1999 | Coon |
| 5,944,446 | A | 8/1999 | Hocking |
| 5,982,801 | A | 11/1999 | Deak |
| 6,044,869 | A | 4/2000 | Koob |
| 6,068,015 | A | 5/2000 | Pringle |
| 6,098,020 | A | 8/2000 | Den Boer |
| 6,112,815 | A | 9/2000 | Bøe et al. |
| 6,112,817 | A | 9/2000 | Voll et al. |
| 6,119,780 | A | 9/2000 | Christmas |
| 6,228,812 | B1 | 5/2001 | Dawson et al. |
| 6,253,847 | B1 | 7/2001 | Stephenson |
| 6,253,861 | B1 | 7/2001 | Carmichael et al. |
| 6,273,194 | B1 | 8/2001 | Hiron et al. |
| 6,305,470 | B1 | 10/2001 | Woie |
| 6,325,152 | B1 | 12/2001 | Kelley et al. |
| 6,338,363 | B1 | 1/2002 | Chen et al. |
| 6,367,547 | B1 | 4/2002 | Towers et al. |
| 6,371,210 | B1 | 4/2002 | Bode et al. |
| 6,372,678 | B1 | 4/2002 | Youngman et al. |
| 6,419,021 | B1 | 7/2002 | George et al. |
| 6,474,413 | B1 | 11/2002 | Barbosa et al. |
| 6,505,682 | B2 | 1/2003 | Brockman |
| 6,516,888 | B1 | 2/2003 | Gunnarson et al. |
| 6,530,431 | B1 | 3/2003 | Castano-Mears et al. |
| 6,561,732 | B1 | 5/2003 | Bloomfield et al. |
| 6,581,681 | B1 | 6/2003 | Zimmerman et al. |
| 6,581,682 | B1 | 6/2003 | Parent et al. |
| 6,622,794 | B2 | 9/2003 | Zisk, Jr. |
| 6,632,527 | B1 | 10/2003 | McDaniel et al. |
| 6,635,732 | B2 | 10/2003 | Mentak |
| 6,667,029 | B2 | 12/2003 | Zhong et al. |
| 6,679,324 | B2 | 1/2004 | Den Boer et al. |
| 6,692,766 | B1 | 2/2004 | Rubinstein et al. |
| 6,699,503 | B1 | 3/2004 | Sako et al. |
| 6,699,611 | B2 | 3/2004 | Kim et al. |
| 6,722,437 | B2 | 4/2004 | Vercaemer et al. |
| 6,786,285 | B2 | 9/2004 | Johnson et al. |
| 6,817,416 | B2 | 11/2004 | Wilson et al. |
| 6,820,690 | B2 | 11/2004 | Vercaemer et al. |
| 6,830,104 | B2 | 12/2004 | Nguyen et al. |
| 6,831,044 | B2 | 12/2004 | Constien |
| 6,840,321 | B2 | 1/2005 | Restarick et al. |
| 6,857,476 | B2 | 2/2005 | Richards |
| 6,863,126 | B2 | 3/2005 | McGlothen et al. |
| 6,896,049 | B2 | 5/2005 | Moyes |
| 6,913,079 | B2 * | 7/2005 | Tubel ..... 166/250.01 |
| 6,938,698 | B2 | 9/2005 | Coronado |
| 6,951,252 | B2 | 10/2005 | Restarick et al. |
| 6,976,542 | B2 | 12/2005 | Henriksen et al. |
| 7,011,076 | B1 | 3/2006 | Weldon et al. |
| 7,032,675 | B2 | 4/2006 | Steele et al. |
| 7,084,094 | B2 | 8/2006 | Gunn et al. |
| 7,159,656 | B2 | 1/2007 | Eoff et al. |
| 7,185,706 | B2 | 3/2007 | Freyer |
| 7,252,162 | B2 | 8/2007 | Akinlade et al. |
| 7,258,166 | B2 | 8/2007 | Russell |
| 7,290,606 | B2 | 11/2007 | Coronado et al. |
| 7,290,610 | B2 | 11/2007 | Corbett et al. |
| 7,318,472 | B2 | 1/2008 | Smith |
| 7,322,412 | B2 | 1/2008 | Badalamenti et al. |
| 7,325,616 | B2 | 2/2008 | Lopez de Cardenas et al. |
| 7,360,593 | B2 | 4/2008 | Constien |
| 7,395,858 | B2 | 7/2008 | Barbosa et al. |
| 7,398,822 | B2 | 7/2008 | Meijer et al. |
| 7,409,999 | B2 | 8/2008 | Henriksen et al. |
| 7,413,022 | B2 | 8/2008 | Broome et al. |
| 7,451,814 | B2 | 11/2008 | Graham et al. |
| 7,469,743 | B2 | 12/2008 | Richards |
| 7,621,326 | B2 | 11/2009 | Crichlow |
| 7,644,854 | B1 | 1/2010 | Holmes et al. |
| 7,647,966 | B2 | 1/2010 | Cavender et al. |
| 7,673,678 | B2 | 3/2010 | MacDougall et al. |
| 2002/0020527 | A1 | 2/2002 | Kilaas |
| 2002/0125009 | A1 | 9/2002 | Wetzel et al. |

| | | | |
|---|---|---|---|
| 2002/0148610 | A1 | 10/2002 | Bussear et al. |
| 2003/0221834 | A1 | 12/2003 | Hess et al. |
| 2004/0052689 | A1 | 3/2004 | Yao |
| 2004/0060705 | A1 | 4/2004 | Kelley |
| 2004/0144544 | A1 | 7/2004 | Freyer |
| 2004/0159447 | A1 | 8/2004 | Bissonnette et al. |
| 2004/0194971 | A1 | 10/2004 | Thomson |
| 2005/0016732 | A1 | 1/2005 | Brannon et al. |
| 2005/0086807 | A1 | 4/2005 | Richard et al. |
| 2005/0126776 | A1 | 6/2005 | Russell |
| 2005/0178705 | A1 | 8/2005 | Broyles et al. |
| 2005/0189119 | A1 | 9/2005 | Gynz-Rekowski |
| 2005/0199298 | A1 | 9/2005 | Farrington |
| 2005/0207279 | A1 | 9/2005 | Chemali et al. |
| 2005/0241835 | A1 | 11/2005 | Burris et al. |
| 2006/0032630 | A1 | 2/2006 | Heins |
| 2006/0042798 | A1 | 3/2006 | Badalamenti et al. |
| 2006/0048936 | A1 | 3/2006 | Fripp et al. |
| 2006/0048942 | A1 | 3/2006 | Moen et al. |
| 2006/0076150 | A1 | 4/2006 | Coronado et al. |
| 2006/0086498 | A1 | 4/2006 | Wetzel et al. |
| 2006/0108114 | A1 | 5/2006 | Johnson |
| 2006/0118296 | A1 | 6/2006 | Dybevik et al. |
| 2006/0124360 | A1 | 6/2006 | Lee et al. |
| 2006/0157242 | A1 | 7/2006 | Graham et al. |
| 2006/0175065 | A1 | 8/2006 | Ross |
| 2006/0185849 | A1 | 8/2006 | Edwards et al. |
| 2006/0250274 | A1 | 11/2006 | Mombourquette et al. |
| 2006/0272814 | A1 | 12/2006 | Broome et al. |
| 2006/0273876 | A1 | 12/2006 | Pachla et al. |
| 2007/0012444 | A1 | 1/2007 | Horgan et al. |
| 2007/0039741 | A1 | 2/2007 | Hailey, Jr. |
| 2007/0044962 | A1 | 3/2007 | Tibbles |
| 2007/0131434 | A1 | 6/2007 | MacDougall et al. |
| 2007/0181299 | A1 | 8/2007 | Chung et al. |
| 2007/0246210 | A1 | 10/2007 | Richards |
| 2007/0246213 | A1 | 10/2007 | Hailey, Jr. |
| 2007/0246225 | A1 | 10/2007 | Hailey Jr. et al. |
| 2007/0246407 | A1 | 10/2007 | Richards et al. |
| 2007/0272408 | A1 | 11/2007 | Zazaovsky et al. |
| 2008/0035349 | A1 | 2/2008 | Bennett |
| 2008/0035350 | A1 | 2/2008 | Henriksen et al. |
| 2008/0053662 | A1 | 3/2008 | Williamson et al. |
| 2008/0135249 | A1 | 6/2008 | Fripp et al. |
| 2008/0149323 | A1 | 6/2008 | O'Malley et al. |
| 2008/0149351 | A1 | 6/2008 | Marya et al. |
| 2008/0169099 | A1 | 7/2008 | Pensgaard |
| 2008/0236839 | A1 | 10/2008 | Oddie |
| 2008/0236843 | A1 | 10/2008 | Scott et al. |
| 2008/0283238 | A1 | 11/2008 | Richards et al. |
| 2008/0296023 | A1 | 12/2008 | Willauer |
| 2008/0314590 | A1 | 12/2008 | Patel |
| 2009/0056816 | A1 | 3/2009 | Arov et al. |
| 2009/0057014 | A1 | 3/2009 | Richard et al. |
| 2009/0101342 | A1 | 4/2009 | Gaudette et al. |
| 2009/0133869 | A1 | 5/2009 | Clem |
| 2009/0133874 | A1 | 5/2009 | Dale et al. |
| 2009/0139717 | A1 | 6/2009 | Richard et al. |
| 2009/0139727 | A1 | 6/2009 | Tanju et al. |
| 2009/0194282 | A1 | 8/2009 | Beer et al. |
| 2009/0205834 | A1 | 8/2009 | Garcia et al. |
| 2009/0301704 | A1 | 12/2009 | Dillett et al. |

FOREIGN PATENT DOCUMENTS

| | | | |
|---|---|---|---|
| GB | 1492345 | | 6/1976 |
| GB | 2341405 | | 3/2000 |
| JP | 59089383 | | 5/1984 |
| SU | 1335677 | | 8/1985 |
| WO | 9403743 | | 2/1994 |
| WO | 0079097 | | 12/2000 |
| WO | 0165063 | | 9/2001 |
| WO | 02075110 | | 9/2002 |
| WO | 2004018833 | A1 | 3/2004 |
| WO | 2006015277 | | 2/2006 |

OTHER PUBLICATIONS

Richard, et al. "Multi-position Valves for Fracturing and Sand Control and Associated Completion Methods". U.S. Appl. No. 11/949,403, filed Dec. 3, 2007.

International Search Report And Written Opinion, mailed Feb. 2, 2010, International Appln. No. PCT/US2009/049661, Written Opinion 7 Pages, International Search Report 3 Pages.

"Rapid Swelling and Deswelling of Thermoreversible Hydrophobically Modified Poly (N-Isopropylacrylamide) Hydrogels Prepared by freezing Polymerisation", Xue, W., Hamley, I.W. and Huglin, M.B., 2002, 43(1) 5181-5186.

"Thermoreversible Swelling Behavior of Hydrogels Based on N-Isopropylacrylamide with a Zwitterionic Comonomer". Xue, W., Champ, S. and Huglin, M.B. 2001, European Polymer Journal, 37(5) 869-875.

An Oil Selective Inflow Control System; Rune Freyer, Easy Well Solutions: Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Baker Oil Tools, Product Report, Sand Control Systems: Screens, Equalizer CF Product Family No. H48688. Nov. 2005. 1 page.

Bercegeay, E. P., et al. "A One-Trip Gravel Packing System," SPE 4771, New Orleans, Louisiana, Feb. 7-8, 1974. 12 pages.

Concentric Annular Pack Screen (CAPS) Service; Retrieved From Internet on Jun. 18, 2008. http://www.halliburton.com/ps/Default.aspx?navid=81&pageid=273&prodid=PRN%3a%3aIQSHFJ2QK.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling and Completion, vol. 12, No. 1, March; pp. 13-18; 1997 Society of Petroleum Engieneers.

Dikken, Ben J., SPE, Koninklijke/Shell E&P Laboratorium; "Pressure Drop in Horizontal Wells and Its Effect on Production Performance"; Nov. 1990, JPT; Copyright 1990, Society of Petroleum Engineers; pp. 1426-1433.

Dinarvand. R., D'Emanuele, A (1995) The use of thermoresponsive hydrogels for on-off release of molecules, J. Control. Rel. 36 221-227.

E.L. Joly, et al. New Production Logging Technique for Horizontal Wells. SPE 14463 1988.

Hackworth, et al. "Development and First Application of Bistable Expandable Sand Screen," Society of Petroleum Engineers: SPE 84265. Oct. 5-8 2003. 14 pages.

Ishihara, K., Hamada, N., Sato, S., Shinohara, I., (1984) Photoinduced swelling control of amphiphdilic azoaromatic polymer membrane. J. Polym. Sci., Polm. Chem. Ed. 22: 121-128.

Mathis, Stephen P. "Sand Management: A Review of Approaches and Conerns," SPE 82240, The Hague, The Netherlands, May 13-14, 2003. 7 pages.

Optimization of Commingled Production Using Infinitely Variable Inflow Control Valves; M.M, J.J. Naus, Delft University of Technology (DUT), Shell International Exploration and production (SIEP); J.D. Jansen, DUT and SIEP; SPE Annual Technical Conference and Exhibtion, Sep. 26-29, Houston, Texas, 2004, Society of Patent Engineers.

Pardo, et al. "Completion, Techniques Used in Horizontal Wells Drilled in Shallow Gas Sands in the Gulf of Mexio". SPE 24842. Oct. 4-7, 1992.

R. D. Harrison Jr., et al. Case Histories: New Horizontal Completion Designs Facilitate Development and Increase Production Capabilites in Sandstone Reservoirs. SPE 27890. Wester Regional Meeting held in Long Beach, CA Mar. 23-25, 1994.

Tanaka, T., Ricka, J., (1984) Swelling of Ionic gels: Quantitative performance of the Donnan Thory, Macromolecules, 17, 2916-2921.

Tanaka, T., Nishio, I., Sun, S.T., Uena-Nisho, S. (1982) Collapse of gels in an electric field, Science, 218-467-469.

* cited by examiner

Traditional Well 18
20
46
48
50
57
59
44
42
52
68
24
52
40
Thermal Liner Hanger
56
Thermal Packer with No Slips & Graphite Enhanced Seals
60
Drilled Holes for Regulating Flow
52
Centralizing Flow Restricter
54
Liner Straddle For Thermal Expansion
58

Parallel Resonance

FIG. 7

The resonance of a parallel RLC circuit is a bit more involved than the series resonance. The resonant frequency can be defined in three different ways, which converge on the same expression as the series resonant frequency if the resistance of the circuit is small.

Different possible definitions of the resonant frequency for a parallel resonant frequency:

1. The frequency at which $\omega L = 1/\omega C$, i.e., the resonant frequency of the equivalent series RLC circuit. This is satisfactory if the resistances are small.

2. The frequency at which the parallel impedance is maximum

3. The frequency at which the current is in phase with the voltage, unity power factor.

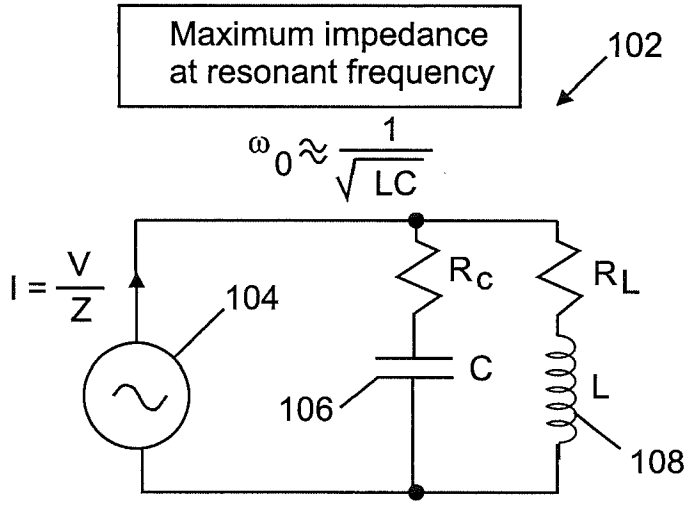

Parallel Resonance

Impedance definition | Phase definition

FIG. 8
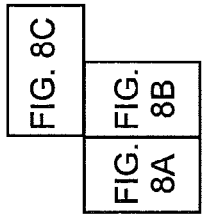
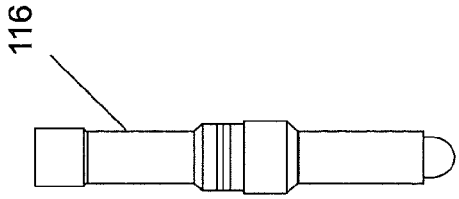
FIG. 8D
FIG. 8C
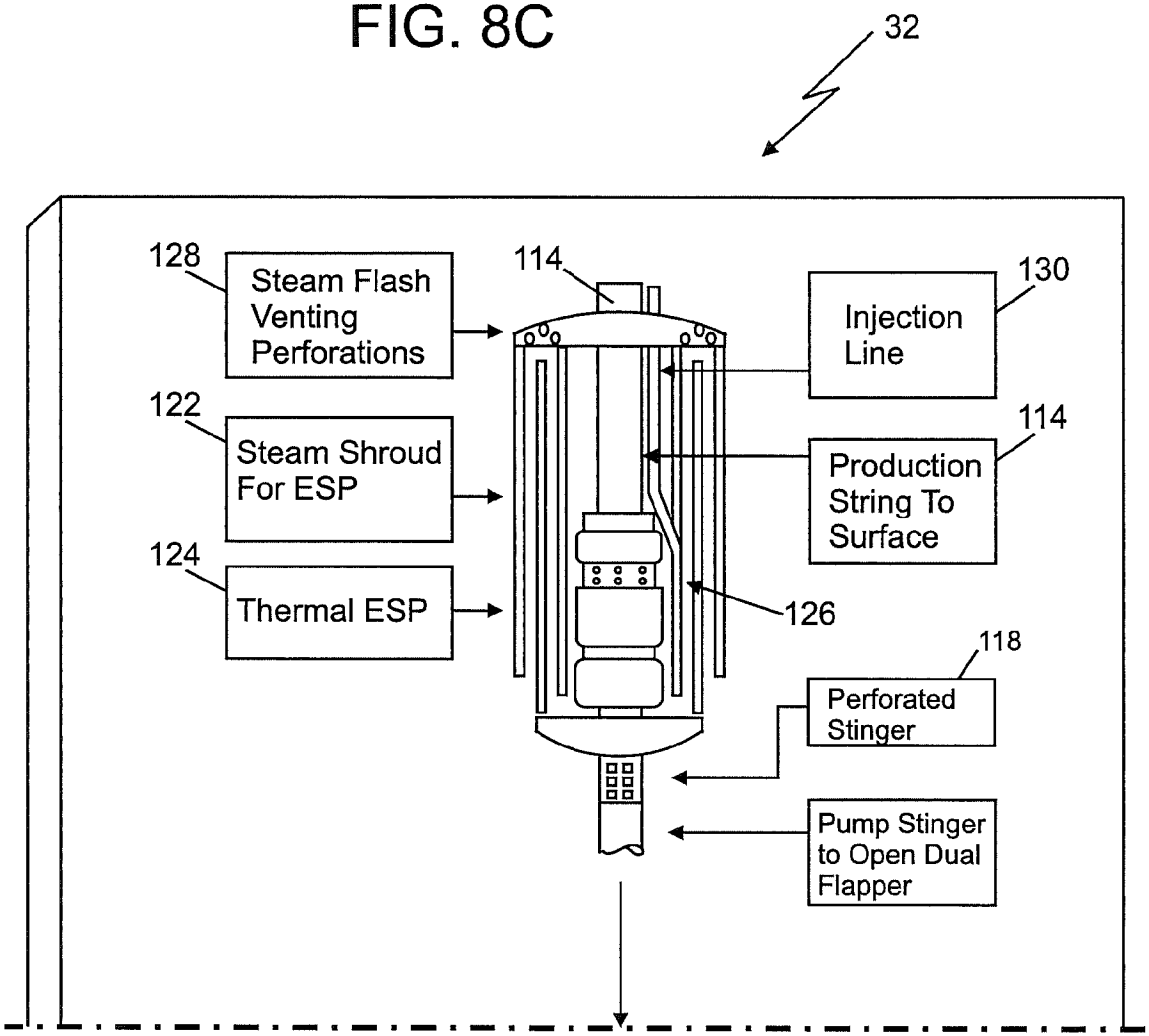

SYSTEMS, METHODS AND APPARATUSES FOR MONITORING AND RECOVERY OF PETROLEUM FROM EARTH FORMATIONS

CROSS REFERENCE TO RELATED APPLICATION

The present application claims priority to U.S. Provisional Patent Application Ser. No. 61/052,919, filed May 13, 2008, the entire contents of which are specifically incorporated herein by reference.

BACKGROUND

Steam Assisted Gravity Drainage (SAGD) is a technique for recovering heavy crude oil and/or bitumen from geologic formations, and generally includes heating the bitumen through an injection borehole until it has a viscosity low enough to allow it to flow into a recovery borehole. As used herein, "bitumen" refers to any combination of petroleum and matter in the formation and/or any mixture or form of petroleum, specifically petroleum naturally occurring in a formation that is sufficiently viscous as to require some form of heating or diluting to permit removal from the formation.

SAGD techniques exhibit various problems that inhibit productivity and efficiency. For example, portions of a heat injector may overheat and warp causing difficulty in extracting an introducer string through the injection borehole. Also, difficulties in maintaining or controlling temperature of the liquid bitumen may pose difficulties in extracting the bitumen. Other problems include the requirement for large amounts of energy to deliver sufficient heat to the formation.

SUMMARY

Disclosed herein is a system for monitoring a location of a borehole for production of petroleum from an earth formation. The system includes: an assembly including at least one of an injection conduit for injecting a thermal source into the formation and a production conduit for recovering material including the petroleum from the formation; a guide conduit attached to at least a portion of the at least one of the injection conduit and the production conduit, the guide conduit extending in a direction at least substantially parallel to the at least one of the injection conduit and the production conduit; and a detection source conduit insertable through the guide conduit and configured to dispose therein a detection source for detecting a location of the assembly in the formation.

Also disclosed herein is a method of monitoring a location of a borehole for production of petroleum from an earth formation. The method includes: inserting a detection conduit through a guide conduit attached to at least a portion of at least one of an injection conduit and a production conduit in the borehole, the guide conduit extending in a direction at least substantially parallel to the at least one of the injection conduit and the production conduit; disposing at least one detection source in the borehole via the detection conduit; advancing the at least one detection source to a selected location; activating the at least one detection source to emit a detection signal; and detecting the detection signal to determine a location of the detection source.

BRIEF DESCRIPTION OF THE DRAWINGS

The following descriptions should not be considered limiting in any way. With reference to the accompanying drawings, like elements are numbered alike:

FIG. 7 depicts an exemplary embodiment of a power supply circuit for the ranging device of FIG. 5;

FIGS. 8A-8D (collectively referred to as FIG. 8) depict an exemplary embodiment of a production assembly of the system of FIG. 1;

FIG. 13 depicts a flow chart providing an exemplary method of producing petroleum from an earth formation.

DETAILED DESCRIPTION

A detailed description of one or more embodiments of the disclosed system and method are presented herein by way of exemplification and not limitation with reference to the Figures.

Figure 1:
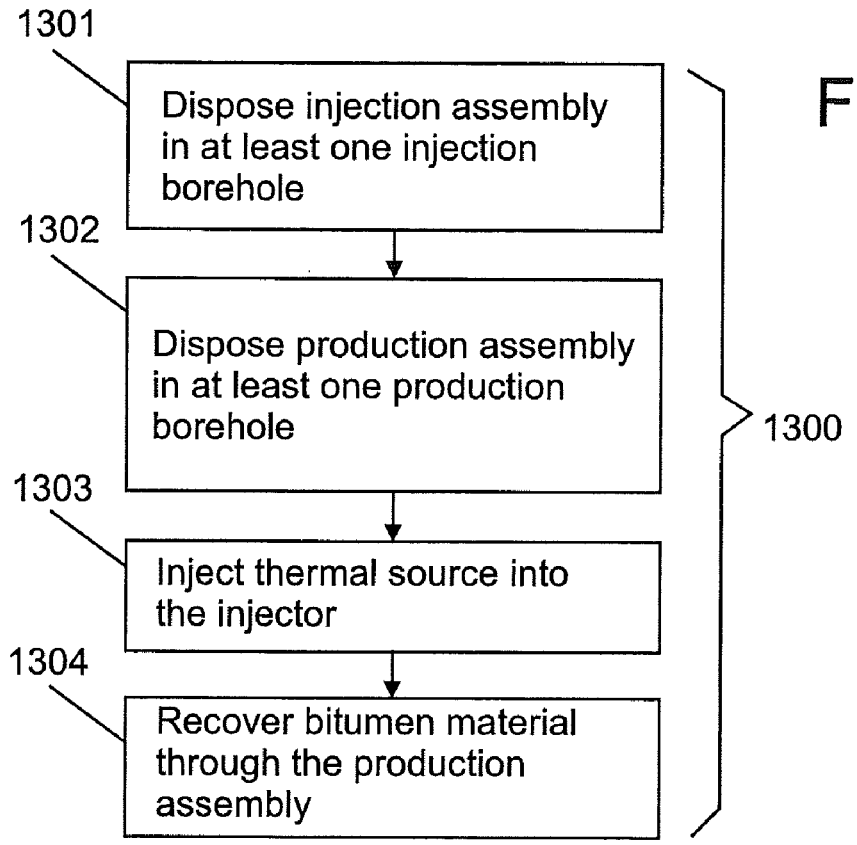

Referring to FIG. 1, an exemplary embodiment of a formation production system 10 includes a first borehole 12 and a second borehole 14 extending into an earth formation 16. In one embodiment, the formation includes bitumen and/or heavy crude oil. As described herein, "borehole" or "wellbore" refers to a single hole that makes up all or part of a drilled borehole. As described herein, "formations" refer to the various features and materials that may be encountered in a subsurface environment. Accordingly, it should be considered that while the term "formation" generally refers to geologic formations of interest, that the term "formations," as used herein, may, in some instances, include any geologic points or volumes of interest (such as a survey area).

The first borehole 12 includes an injection assembly 18 having an injection valve assembly 20 for introducing steam from a thermal source (not shown), an injection conduit 22 and an injector 24. The injector 24 receives steam from the conduit 22 and emits the steam through a plurality of openings such as slots 26 into a surrounding region 28. Bitumen 27 in region 28 is heated, decreases in viscosity, and flows substantially with gravity into a collector 30.

A production assembly 32 is disposed in second borehole 14, and includes a production valve assembly 34 connected to a production conduit 36. After region 28 is heated, the bitumen 27 flows into the collector 30 via a plurality of openings such as slots 38, and flows through the production conduit 36, into the production valve assembly 34 and to a suitable container or other location (not shown). In one embodiment, the bitumen 27 flows through the production conduit 36 and is recovered by one or more methods including natural steam lift, where some of the recovered hot water condensate flashes in the production conduit 36 and lifts the column of fluid to the surface, by gas lift where a gas is injected into the conduit 36 to lift the column of fluid, or by pumps such as progressive cavity pumps that work well for moving high-viscosity fluids with suspended solids.

In this embodiment, both the injection conduit 22 and the production conduit 36 are hollow cylindrical pipes, although they may take any suitable form sufficient to allow steam or bitumen to flow therethrough. Also in this embodiment, at least a portion of boreholes 12 and 14 are parallel horizontal boreholes. In other embodiments, the boreholes 12, 14 may advance in a vertical direction, a horizontal direction and/or an azimuthal direction, and may be positioned relative to one another as desired.

Figure 1A:
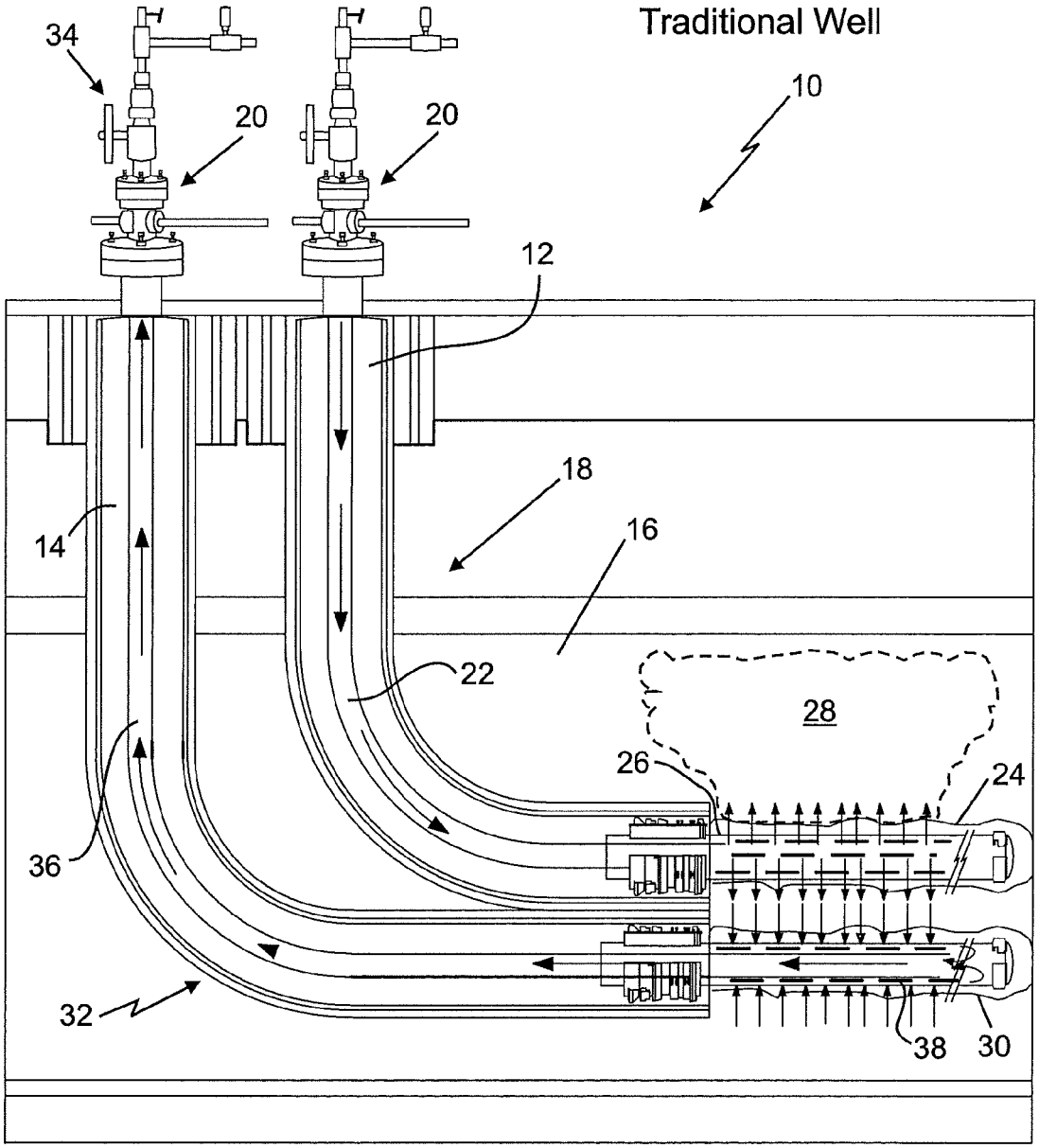
FIGS. 1A-1B (collectively referred to as FIG. 1) depict an exemplary embodiment of a formation production system.
Figure 1B:
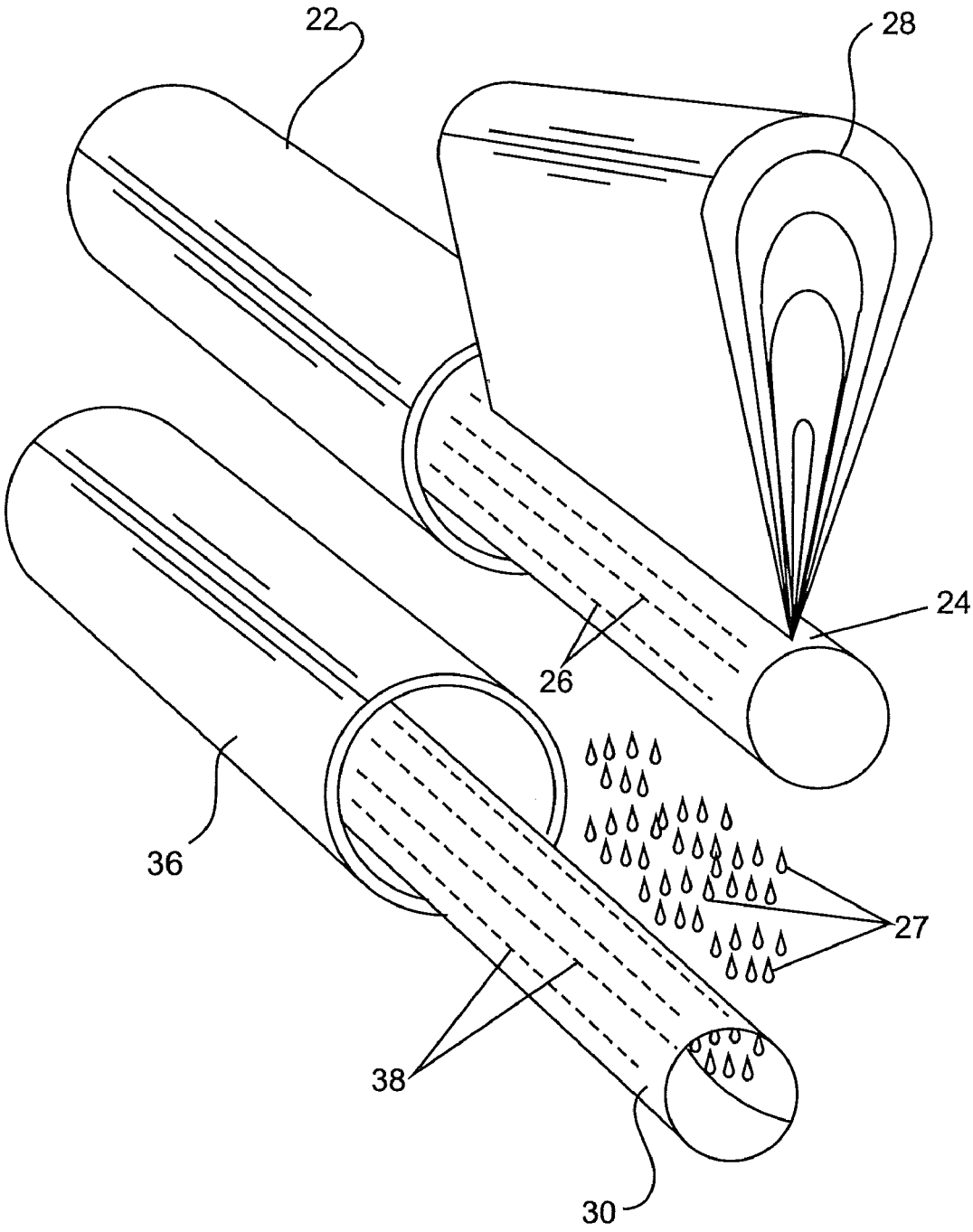
Figures 2, 2A, 2B:
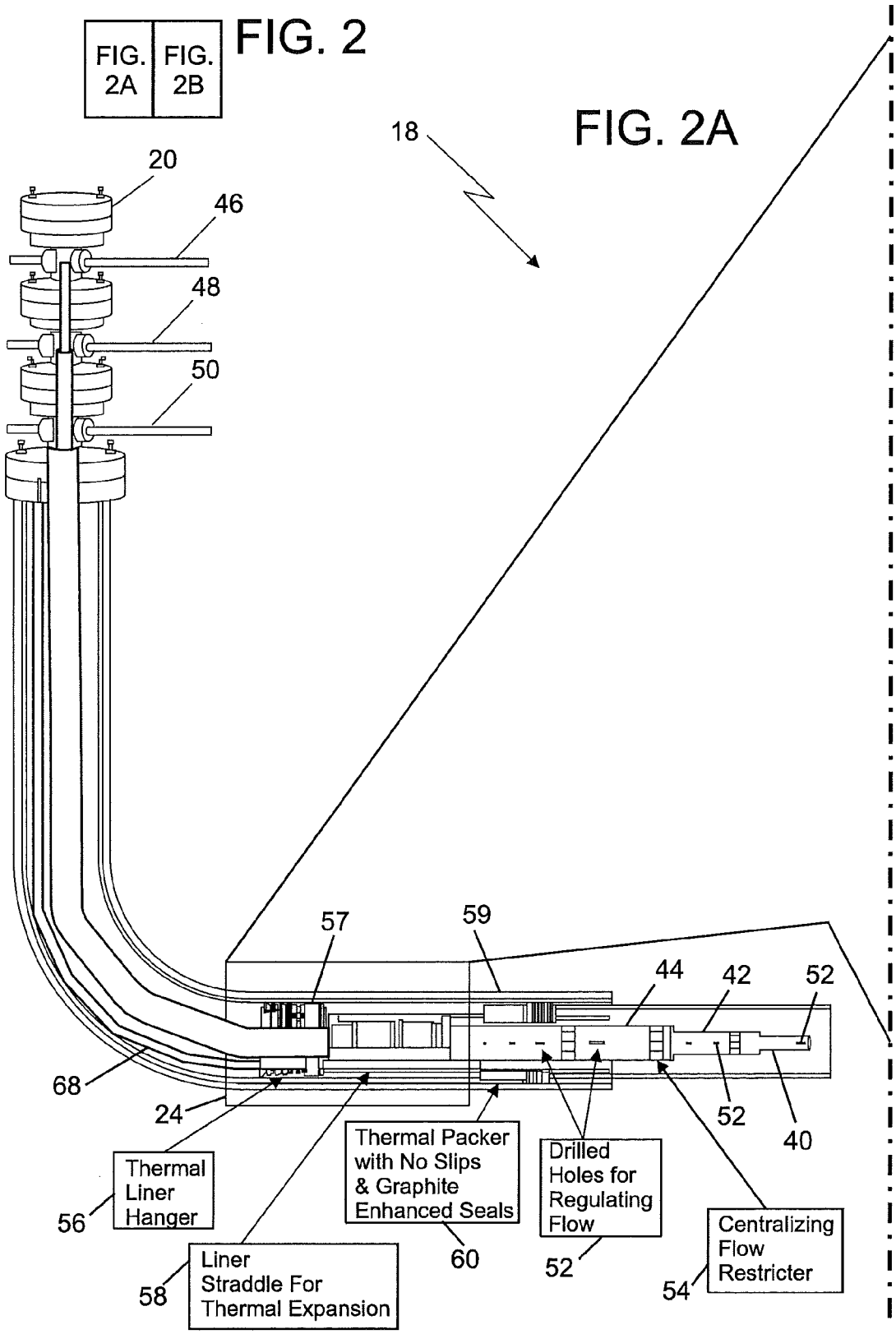
FIGS. 2A-2B (collectively referred to as FIG. 2) depict an exemplary embodiment of an injection assembly of the system of FIG. 1.
Figure 2B:
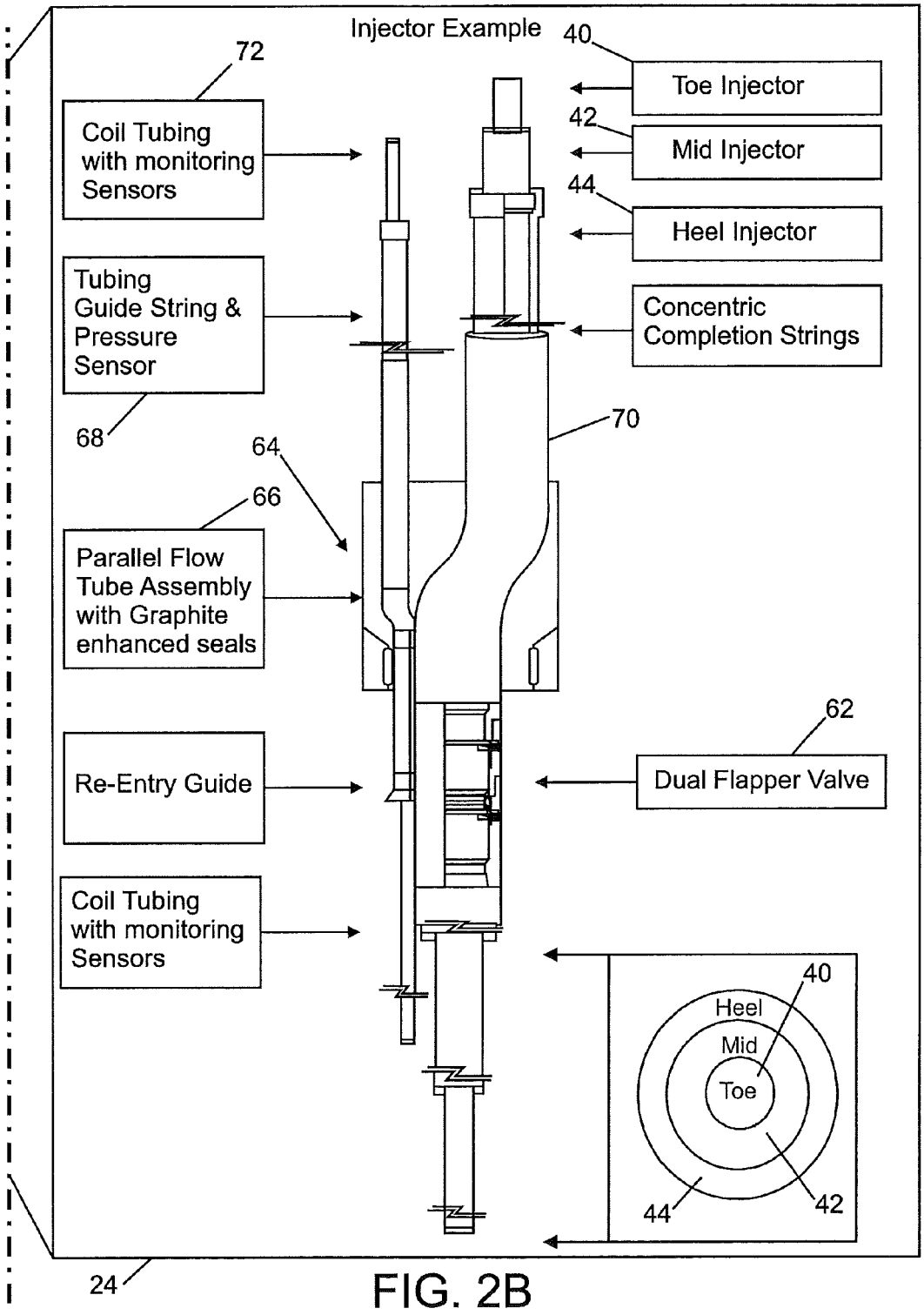

Referring to FIG. 2, an embodiment of the injection assembly 18 is shown. In this embodiment, conduit 22 includes three concentric conduits or strings 40, 42 and 44, which are each separately injectable with steam from the valve assembly which has three separate input ports 46, 48 and 50. As shown in FIG. 2, a toe injector string 40 is connected to a toe injection port 46, a mid injector string 42 is connected to a mid injection port 48, and a heel injector string 44 is connected to a heel injection port 50. As used herein, "toe" refers to a selected point or location in the borehole 12, 14 away from the surface, "mid" refers to a point in the borehole 12, 14 that is closer to the surface of the borehole along the length of the borehole than the toe-point, and "heel" refers to a point in the borehole 12, 14 that is closer to the surface than the mid-point. In some instances, the heel is usually at the intersection of a more vertical length of the borehole and a more horizontal section of the borehole. The toe is usually at the end section of the borehole. The toe point may also be referred to as a "distal" point. A "proximal" point refers to a point in the borehole 12, 14 that is closer to the surface, along the path of the borehole 12, 14, than the distal point.

The heel injector string 44 has a first inner diameter and extends to a first point at a distal end of the borehole 12 when the injector 24 is located at a heel-point in the borehole 12. As referred to herein, "distal end" refers to an end of a component that is farthest from the surface of a borehole, along a direction extending along the length of the borehole, and "proximal end" refers to an end of the component that is closest to the surface of the borehole along the direction extending along the length of the borehole. The mid injector string 42 has a first outer diameter that is smaller than the first inner diameter, has a second inner diameter, and extends to a mid-point. The toe injector string 40 has a second outer diameter that is smaller than the second inner diameter and extends to a toe-point. Each string 40, 42, 44 has a plurality of openings 52 such as drilled holes or slots that regulate the flow of steam through and out of each string 40, 42, 44. The heel injector string 44 and the mid injector string 42 may also include a centralizing flow restrictor 54. Injecting steam independently to the interior of each string 40, 42, 44 allows a user to control the flow of steam through each string independently, such as by varying injection pressure and/or varying a distribution of openings 52. This allows the user to adjust each string to ensure that an even distribution of steam is provided along the injector 24, and no hot spots are formed that could potentially warp or damage portions thereof Furthermore, this configuration allows a user to conserve energy, for example, by providing lower temperature or pressure steam into the toe injection port 46. This is possible due to the insulative properties of the surrounding strings 42, 44 that thereby reduce thermal loss while the steam is flowing to the toe. Losses in prior art configurations necessitate the introduction of steam at much higher temperatures in order to still have sufficient thermal energy left by the time the steam reaches the toe to effectively reduce viscosity of the bitumen.

Referring again to FIG. 2, the injector 24 includes one or more additional components, such as a thermal liner hanger 56, a liner straddle 58 for thermal expansion, and a thermal packer 60 for isolating a portion of the borehole 12. In one embodiment, the injector 24 includes a dual flapper valve 62 or other valve device to prevent back-flow of the steam. In one embodiment, a second packer 57 is included. Packer 57 may be incorporated with a parallel flow tube assembly 66 and/or the thermal liner hanger 56. The packers 57 and 60 may each be any suitable type of packer, such as an inflatable and/or elastomeric packer.

In one embodiment, the packer 60 does not include any slips, and is provided in conjunction with another packer, such as a packer 57. The packer 57 includes one or more slips for securing the packer 57 to the borehole 12 or to a well string 59. The well string 59 is thus attached to the packer 57, and is connected but not attached to the packer 60. The well string 59 is a tubular pipe or any suitable conduit through which components of the injection assembly 18 are disposed. In one embodiment, the well string 59 is a continuous conduit extending between packers 57 and 60. This configuration allows the well string to thermally expand without the need for an expansion joint. Use of an expansion joint can be problematic if expansion is excessive, and thus this configuration is advantageous in that an expansion joint is unnecessary.

In one embodiment, the injector 24 includes a monitoring/sensing assembly 64 that includes the parallel flow tube assembly 66 that may act as a packer and holds the strings 40, 42, 44 relative to a guide conduit 68. The guide conduit 68 is attached to an exterior housing 70. A monitoring/sensing conduit 72 is disposed in the guide conduit 68 for introduction of various monitoring or sensing devices, such as pressure and temperature sensors. In one embodiment, the monitoring/sensing conduit 72 is configured to allow the insertion of various detection sources such as magnetic sources, point of nuclear sources, electro-magnetic induction coils with resistors, acoustical devices, transmitting devices such as antennas, well logging tools and others. In one embodiment, the monitoring/sensing conduit is a coil tubing.

Figure 3:
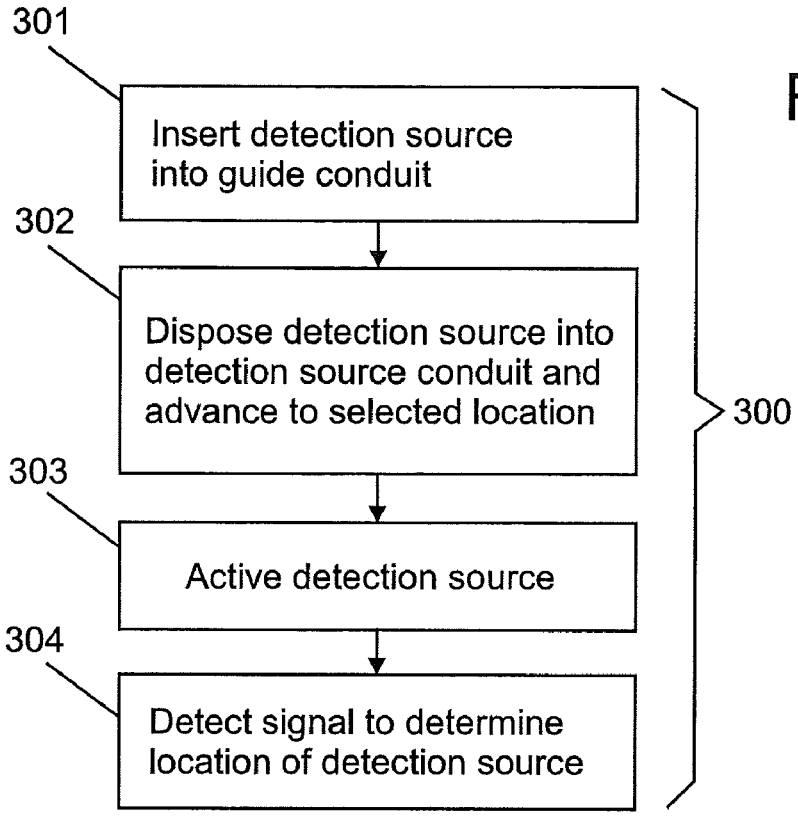
FIG. 3 depicts a flow chart providing an exemplary method of monitoring a location of a borehole for production of petroleum from an earth formation.

The systems described herein provide various advantages over existing processing methods and devices. The concentric injection strings provide for greater control of injection and assure a consistent distribution of steam relative to prior art injectors. Furthermore, no expansion joint is required, a flow back valve prevents steam from flowing back into the conduit 22 which improves efficiency. In addition, ease of installation is improved, a more effective and quicker pre-heat is accomplished as multiple steam conduits provide quicker heating, and greater thermal efficiency is achieved as the steam emission is precisely controllable and each conduit is more effectively insulated such as by sealed annulars with gas insulation. Furthermore, the assemblies described herein allow for improved monitoring and improved intervention ability relative to prior art assemblies. FIG. 3 illustrates a method 300 of monitoring a location of a borehole for production of petroleum from an earth formation. The method 300 includes one or more stages 301-304. In one embodiment, the method 300 includes the execution of all of stages 301-304 in the order described. However, certain stages may be omitted, stages may be added, or the order of the stages changed. Although the method 300 is described in conjunction with the injection and production assemblies described herein, the method 300 may be utilized in conjunction with any production system to regulate thermal characteristics of material produced from an earth formation.

In the first stage 301, a detection conduit such as the monitoring/sensing conduit 72 is inserted into the guide conduit 68.

In the second stage 302, at least one detection source is disposed in the borehole 12, 14 through the detection conduit and advanced to a selected location. In one embodiment, the detection source is advanced by hydraulically lowering the detection source through the detection conduit.

In the third stage 303, the detection source is activated to emit a detection signal.

In the fourth stage 304, the detection signal is detected by a detector to determine a location of the detection source. In one embodiment, the detector is located at the surface or an another borehole.

Figure 4:
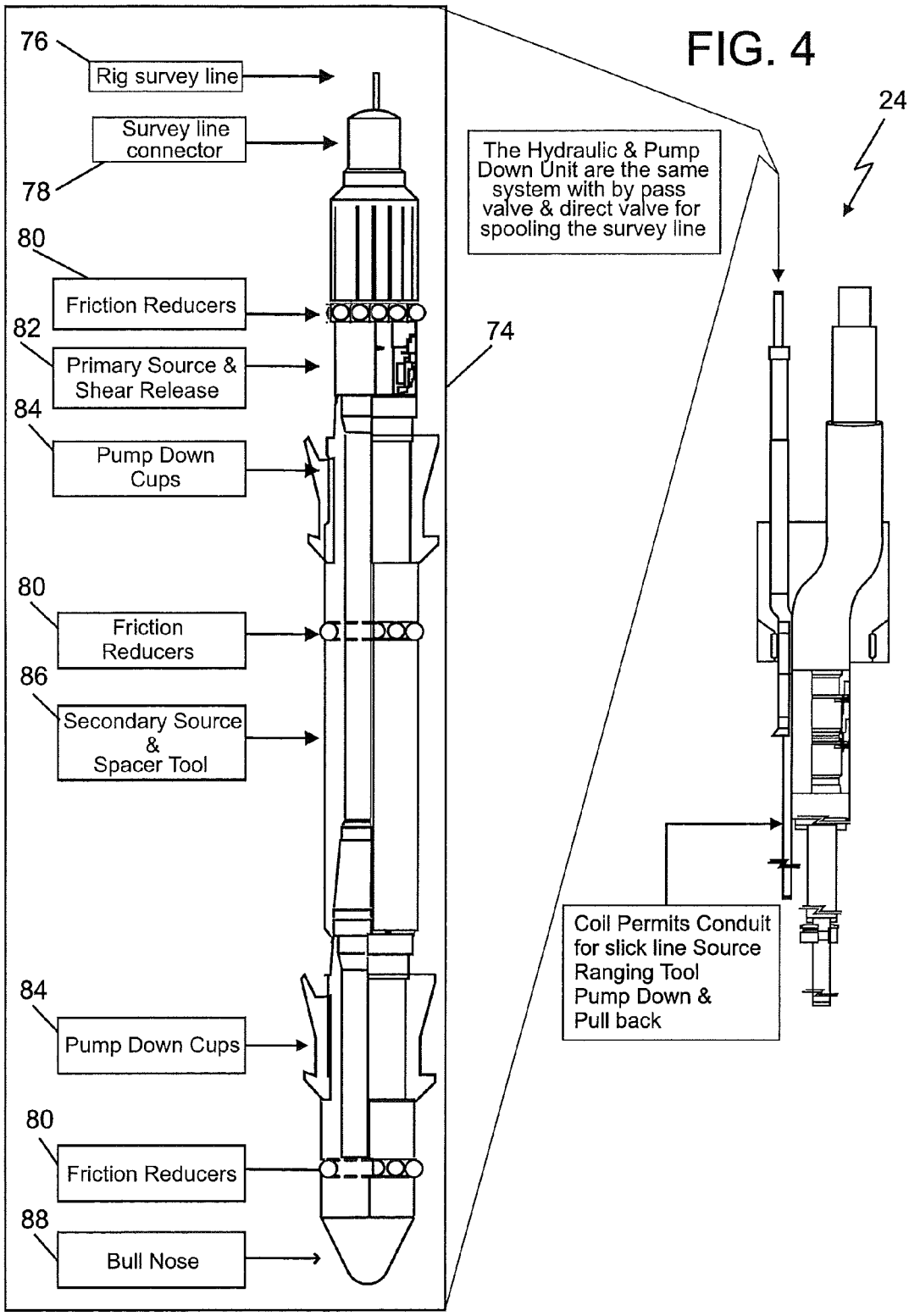
FIG. 4 depicts an exemplary embodiment of an injector and a monitoring device of the system of FIG. 1.
Figure 5B:
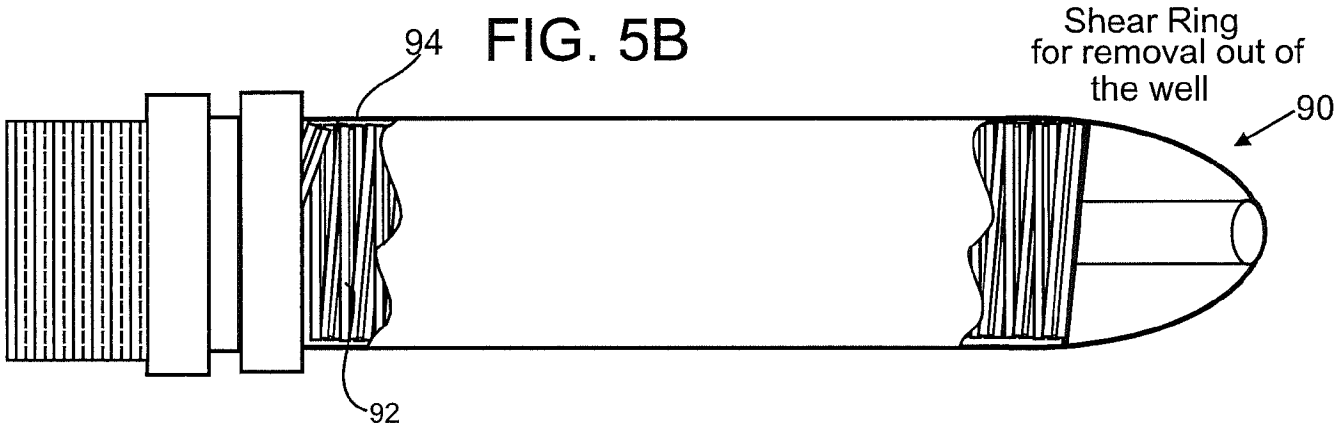
FIGS. 5A-5G (collectively referred to as FIG. 5) depict an exemplary embodiment of a ranging device of the monitoring device of FIG. 4.
Figure 5C:
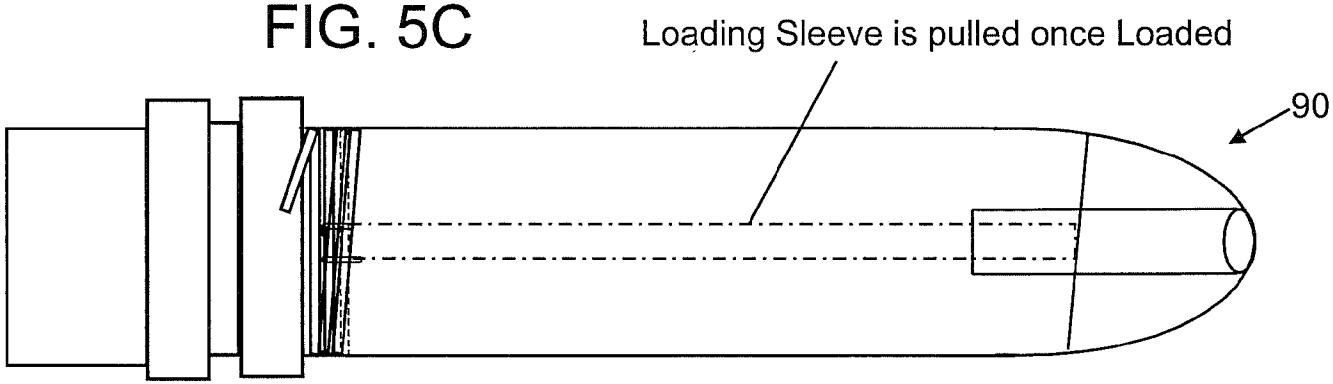
Figure 5A:
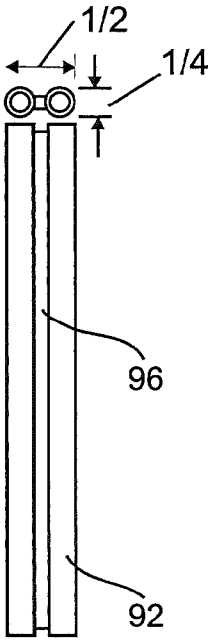
Figure 5E:
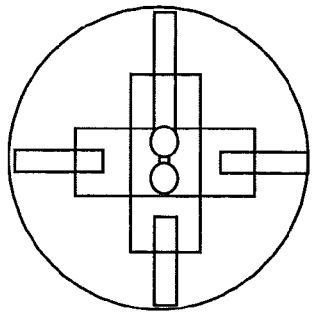
Figure 5D:
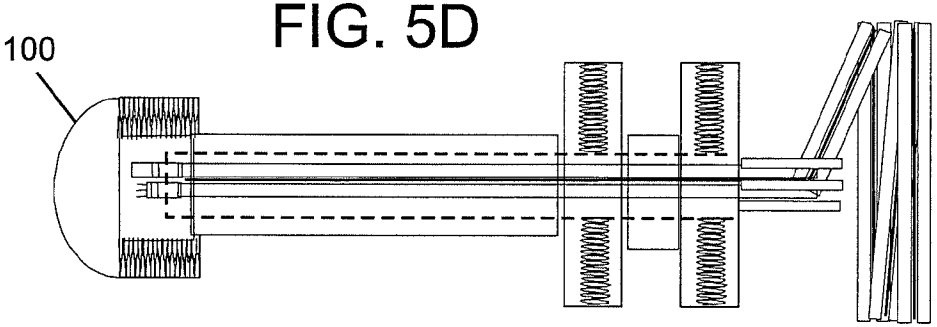
Figure 5F:
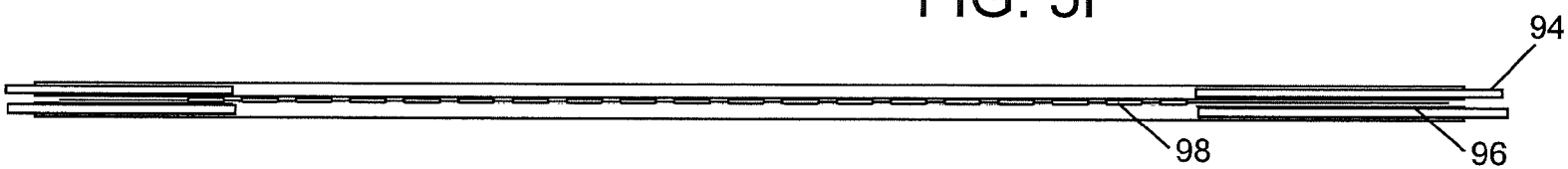
Figure 5G:
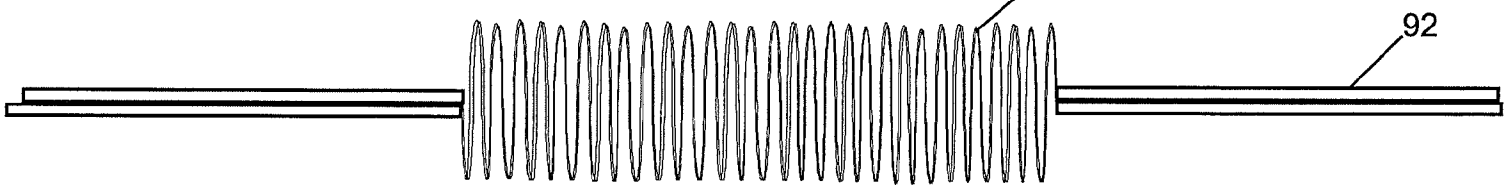

Referring to FIG. 4, a monitoring and/or sensing device 74 is lowered into the monitoring/sensing conduit 72. In one embodiment, the monitoring and/or sensing device 74 is a submersible ranging tool 74. In one embodiment, the tool 74 is configured to be hydraulically lowered through the monitoring/sensing conduit, and is retrievable via a survey line 76 that is attached to the tool 74 via a line connector 78. Other components include friction reducers 80, a primary source and shear release 82, pump down cups 84 to respond to hydraulic pressure, a secondary source and spacer tool 86, and a bull nose 88. This configuration may be used to dispose a ranging device for location of a selected portion of the borehole 12. This configuration exhibits numerous advantages, in that it is simpler and less expensive than prior art systems, does not require a line tractor to retract the ranging device, does not require an electric line, is easily retrievable, and is faster and more effective than prior art systems. In one embodiment, the monitoring and/or sensing device 74 includes one or more detection sources such as magnetic sources, point of nuclear sources, electro-magnetic induction coils with resistors, acoustical devices, transmitting devices such as antennas, well logging tools and others. In one embodiment, the ranging tool 74 includes the rig survey line 76, which may be a slick line, an electric line or other device for moving the ranging tool along the length of the borehole 12.

Referring to FIG. 5, an embodiment of a ranging device 90 is provided that includes a magnetic source that is detectable in order to accurately measure the location of a borehole. This is important in locating existing boreholes to avoid unwanted interference with subsequently drilled boreholes. The ranging device 90, in one embodiment, is disposed within the ranging tool 74. The ranging device 90 and/or the ranging tool 74 are particularly useful during the drilling phase of petroleum production, in which injection, production and/or other wells are initially drilled. The ranging device 90 includes an elongated, electrically conductive member such as an electrically conductive cable or wire 92. In one embodiment, a selected length of the cable 92 is coiled within a housing 94. The cable 92 includes, in one embodiment, a material 96 disposed in the wire to provide a strengthening effect.

In one embodiment, the cable 92 includes an electrosensitive material 98 that changes shape based on the application of an electric current. In one embodiment, the electrosensitive material 98 is an electrosensitive shape memory alloy, which reacts to thermal or electrical application to change shape, and/or a electrically sensitive polymer. The electrosensitive material, in one embodiment, is disposed in one or more selected portions along the length of the cable 92.

In use, the cable 92 is uncoiled from the ranging device 90 after the ranging device 90 is advanced through the borehole 12, such as by retracting a retrieval head 100, or is otherwise extended along a selected length of the borehole 12 by any other suitable method. When an electric current or voltage is applied to the cable 92, the electrosensitive material changes shape, causing the cable 92 to form a coil at selected locations along the length of the cable 92. Each of these coils creates a magnetic field that is detectable by a detector to locate the corresponding location in the borehole 12. The voltage or current may be adjusted to cause the electrosensitive material to react accordingly, to change the length of the coil or location of the magnetic field along the cable 92. In one embodiment, resistors are positioned in and/or around the coils to permit a selected current to enter or bypass a specific coil or specific portion of a coil. In this way, the current or voltage may be adjusted to cause current to enter only selected coils. An exemplary configuration of the resistors is shown in FIG. 7, in which a first resistor "$R_L$" is disposed in series with a coil "L", and a second resistor "$R_C$" is disposed in parallel with the coil L. Such connections, in one embodiment, is accomplished by disposing dual conductors in the cable 92, which are electrically connected by cross-filaments. In another embodiment, such resistors are configured so that a selected current can be applied to the cable 92 to energize all of the coils.

In one embodiment, the cable 92 and/or the housing 94 is incorporated in the ranging tool 74. For example, the rig survey line 76 is replaced with the cable 92, so that the ranging tool 74 need not be moved along the borehole 12 in order to move a magnetic field along the borehole 12. In this embodiment, the ranging tool 74 includes magnetic field sources in the form of the coils of cable 192, as well as any desired additional sources such as magnetic sources, point of nuclear sources, electro-magnetic induction coils with resistors, acoustical devices, transmitting devices such as antennas, and well logging tools.

In other embodiments, other components are disposed along the length of the cable 92, to provide ranging or other information. Examples of such components include point of nuclear sources, electro-magnetic induction coils with resistors, acoustical devices, transmitting devices such as antennas, well logging tools and others.

Figure 6:
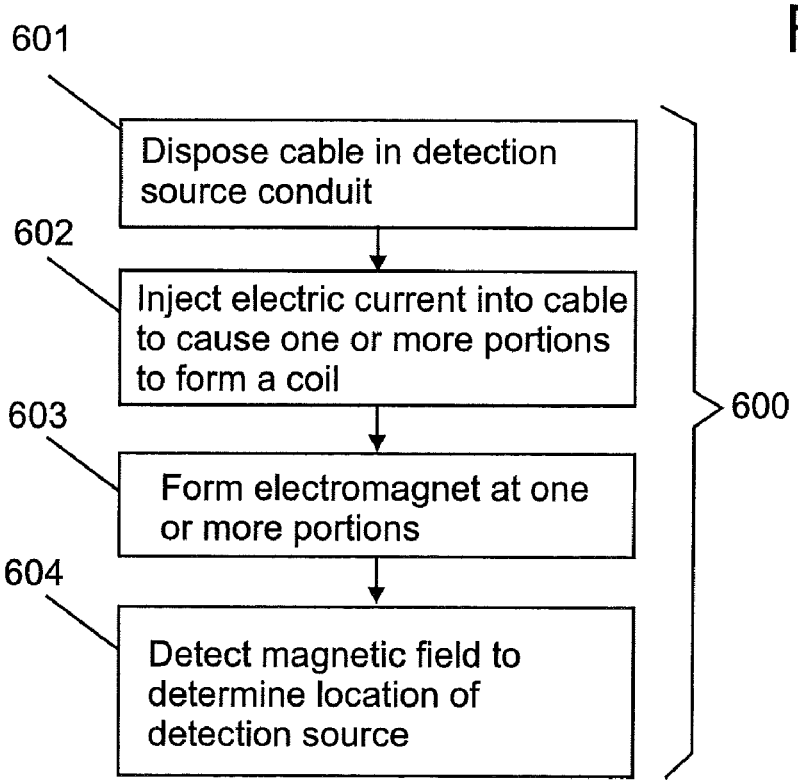
FIG. 6 depicts a flow chart providing an exemplary method of monitoring a location of a borehole for production of petroleum from an earth formation.

FIG. 6 illustrates a method 600 of monitoring a location of a borehole for production of petroleum from an earth formation. The method 600 includes one or more stages 601-604. In one embodiment, the method 600 includes the execution of all of stages 601-604 in the order described. However, certain stages may be omitted, stages may be added, or the order of the stages changed. Although the method 600 is described in conjunction with the injection and production assemblies described herein, the method 600 may be utilized in conjunction with any production system to regulate thermal characteristics of material produced from an earth formation.

In the first stage 601, the cable 92 is disposed in a detection source conduit such as the monitoring/sensing conduit 72 that extends at least substantially parallel to the borehole 12, 14.

In the second stage 602, an electric current is applied to the cable 92 to cause the electrosensitive material 98 to change shape and cause one or more portions of the cable 92 to form a coil.

In the third stage 603, an electromagnet is formed at the one or more portions responsive to the electric current.

In the fourth stage 604, the magnetic field is detected by a detector to determine a location of the detection source. In one embodiment, the detector is located at the surface or an another borehole.

Referring to FIG. 7, a circuit 102 is coupled to the cable 92 to apply a voltage to the cable 92. In one embodiment, the circuit 102 is a resistor-inductor-capacitor (RLC) circuit, such as the parallel RLC circuit 102. The circuit 102 includes an alternating current source 104, a capacitor 106 ("C") having a resistance $R_C$, and an inductor 108 ("L") having a resistance $R_L$. The resonant frequency of the circuit 102 can be defined in three different ways, which converge on the same expression on the corresponding series RLC circuit if the resistance of the circuit 102 is small. Definitions of the resonant frequency $\omega_0$, which is approximately equal to 1/sqrt (LC), include i) the frequency at which $\omega_L$, $=1/\omega_C$, i.e., the resonant frequency of the equivalent series RLC circuit, ii) the frequency at which the parallel impedance is at a maximum, and iii) the frequency at which the current is in phase with the voltage, the circuit having a unity power factor.

This configuration is advantageous over prior art sources that use sources such as acoustical and magnetic sources, in that the ranging device 90 does not need to be moved through the borehole 12 to detect different portions of the borehole 12. The ranging device is advantageous in that it reduces costs, increases drilling efficiency, eliminates the need for line trucks to move the source, increases accuracy due to the built in resistors, allows for faster relocation of magnetic sources by increasing voltage, is fully retrievable and reusable, and is potentially unlimited in length.

Figure 8A:
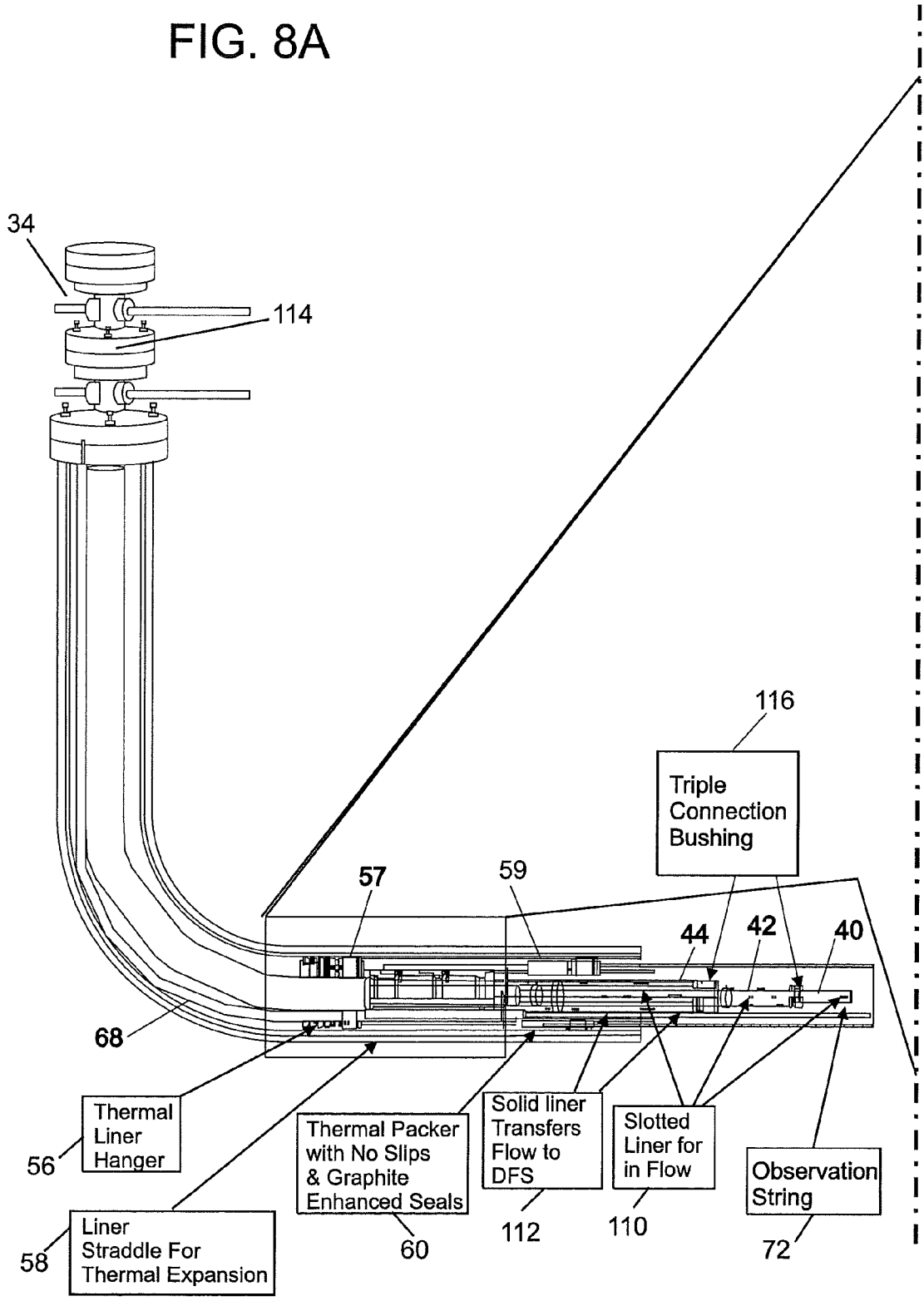
Figure 8B:
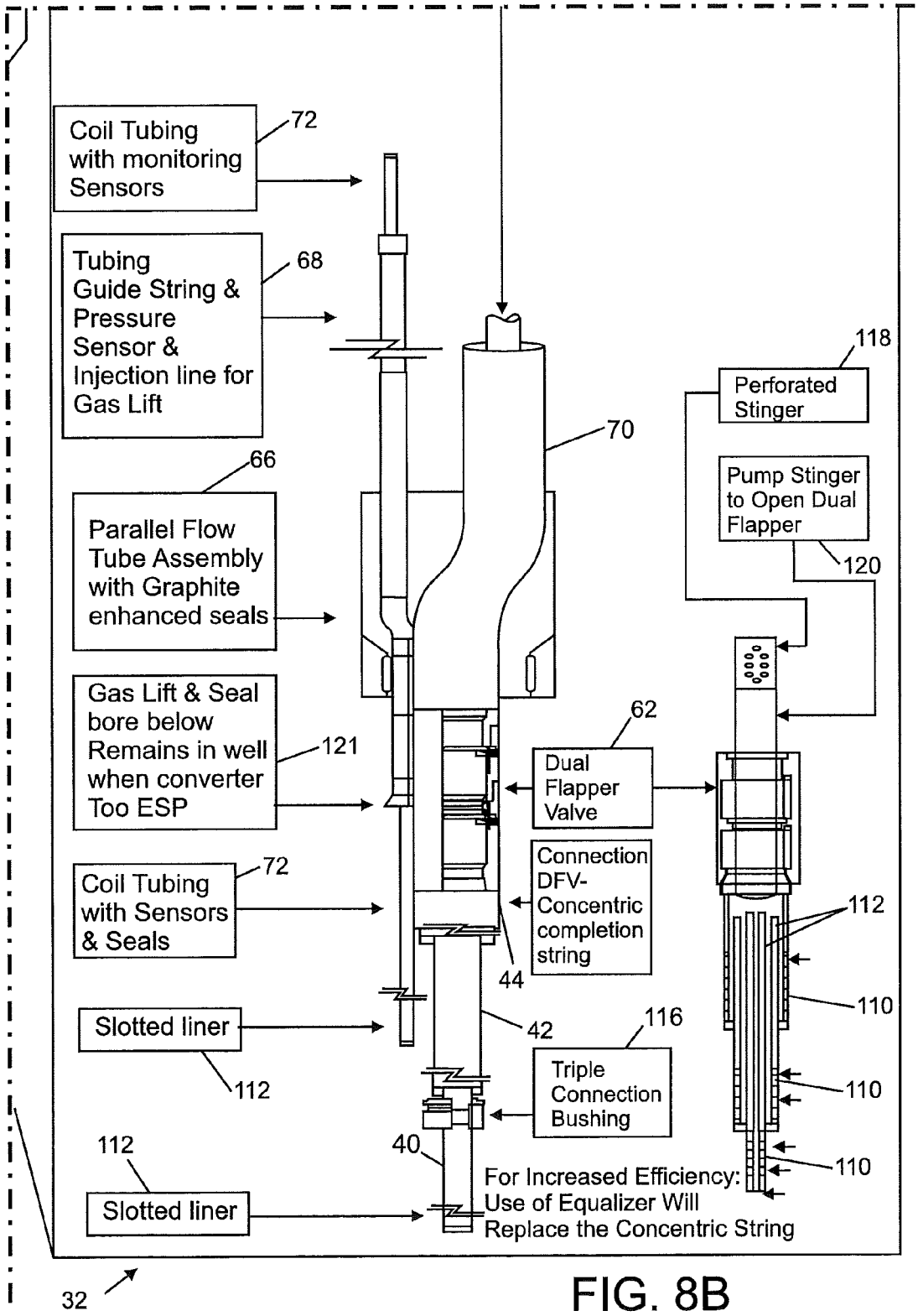

Referring to FIG. 8, an embodiment of the collector 30 and the production conduit 36 is shown. In this embodiment, one or more of the concentric strings 40, 42 and 44 each receive fluid bitumen through openings 110, which proceeds into solid portions 112 which are connected in fluid communication with a production string 114 via the dual flapper valve 62. The solid portions 112 are impermeable to the bitumen. In one embodiment, a solid portions 112 is a portion of the surface of a string, such as string 40 and 42, that are surrounded by another string, such as string 42 and 44. In one embodiment, the concentric strings 40, 42 and 44 are coupled to the production string 114 via a triple connection bushing 116. Bitumen entering each solid portion for a respective string 40, 42, 44 will not migrate into a different string until the bitumen from each string are combined in a mixing chamber formed within the string 40 and/or the bushing 116. In one embodiment, the bushing 116 connects the concentric strings 40, 42 and 44 to a perforated stinger 118 and a pump stinger 120.

In one embodiment, the guide conduit 68 includes a stinger to attach the guide conduit 68 to the production string to aid in recovery of the bitumen. In this embodiment, the monitoring/sensing assembly includes a gas lift 121, which includes the stinger to introduce a gas in the pump stinger 120, paths formed by the solid portions 112 and/or the production string 114, to reduce viscosity and aid in recovering the bitumen. The gas lift may be utilized with or without a pump. In one embodiment, a one-way valve is disposed between the guide conduit 68 and the injector 24 to prevent flow of bitumen or other materials into the guide conduit 68.

In one embodiment, a steam shroud 122 is disposed around the production string 114 and a pump 124. In one embodiment, the pump 124 is an electric submersible pump (ESP). Other pumps may be utilized, such as rod pumps and hydraulic pumps.

The steam shroud includes at least one conduit 126 that is concentric with the production string 114 and is in fluid communication with the production string 114. As the pump 124 pumps the bitumen toward the surface, a portion of the bitumen is forced into the concentric conduit 126 and toward steam flash venting perforations 128, through which excess steam can escape. The bitumen, as a result, increases in viscosity, and accordingly travels downward (i.e., away from the surface) and continues through the production string 114. In one embodiment, an injection line 130 extends into the conduit 126 for introduction of monitoring devices or cooling materials, such as a liquid, a gas or a chemical agent.

In one embodiment, during the petroleum recovery process, steam is injected through one or more of the injector strings 40, 42, 44 and is recovered through any one or more of the production strings. In one example, steam is injected through 40, 42, and recovered through the heel production string. Utilizing any such desired combinations may require less energy, and may also allow faster pre-heating with less energy than prior art techniques.

Figure 9:
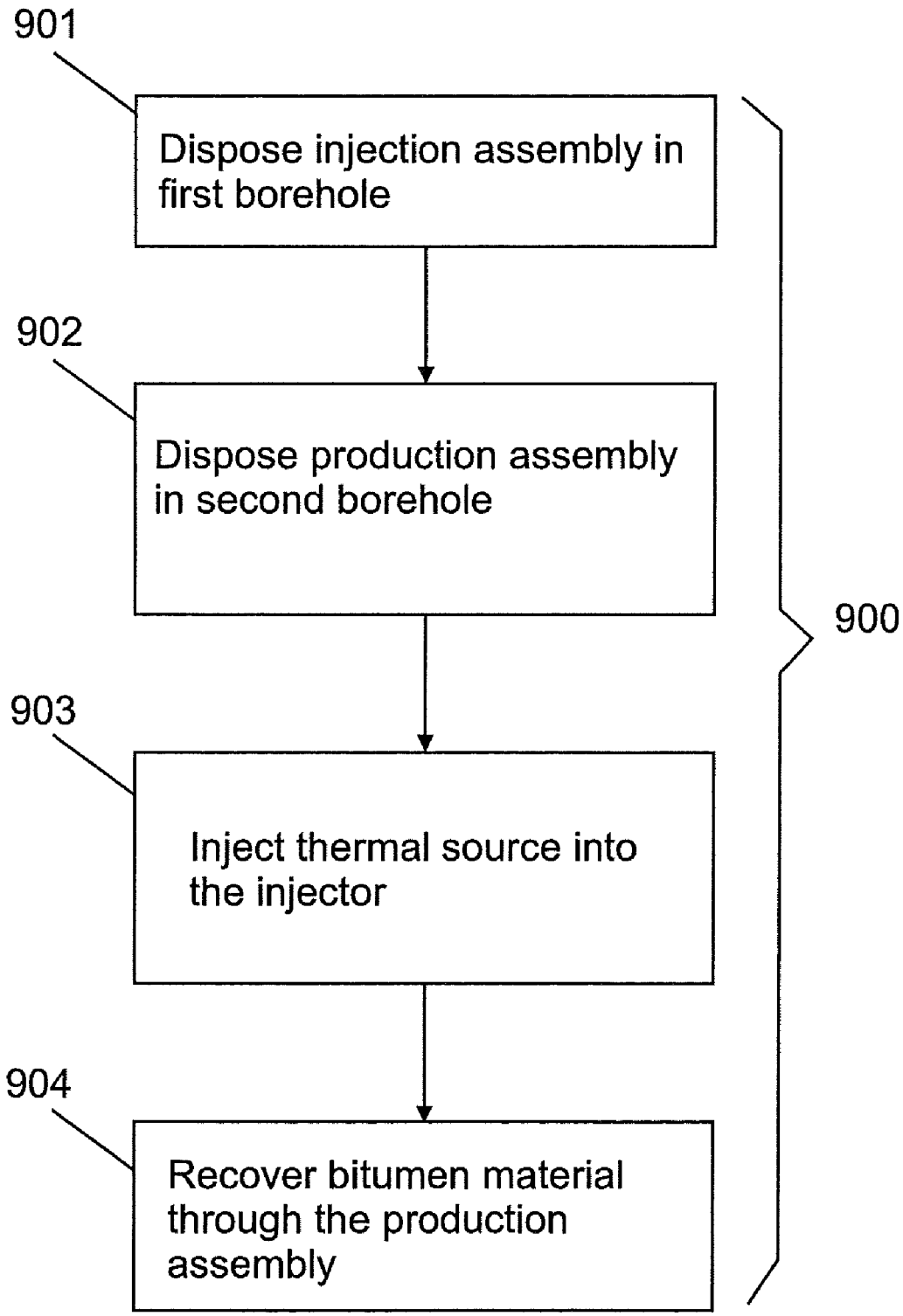
FIG. 9 depicts a flow chart providing an exemplary method of producing petroleum from an earth formation.

FIG. 9 illustrates a method 900 of producing petroleum from an earth formation. The method 900 includes one or more stages 901-904. In one embodiment, the method 900 includes the execution of all of stages 901-904 in the order described. However, certain stages may be omitted, stages may be added, or the order of the stages changed. Although the method 900 is described in conjunction with the injection and production assemblies described herein, the method 900 may be utilized in conjunction with any production system to regulate thermal characteristics of material produced from an earth formation.

In the first stage 901, an injection assembly such as the injection assembly 18 is disposed in the first borehole 12, and advanced through the borehole 12 until the injector 24 is located at a selected location.

In the second stage 902, a production assembly such as the production assembly 32 is disposed in the second borehole 14, and advance through the borehole 14 until the collector 30 is positioned at a selected location. In one embodiment, the selected location is directly below, along the direction of gravity, the injector 24.

In the third stage 903, a thermal source such as steam is injected into the injector to introduce thermal energy to a portion of the formation 16 and reduce a viscosity of the material therein, such as bitumen. In one embodiment, the thermal source is injected through the openings 52 in one or more of the strings 40, 42, 44.

In the fourth stage 904, the material migrates with the force of gravity and is recovered through the production assembly. In one embodiment, the material is recovered through the openings 110 in one or more of the strings 40, 42, 44.

Figure 10A:
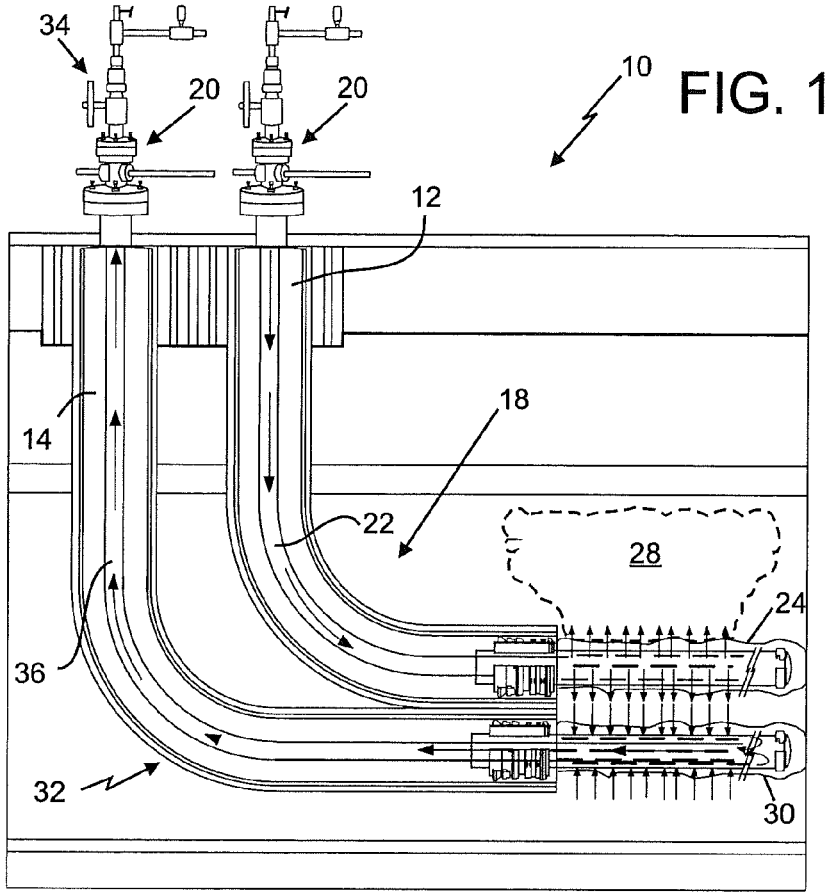
FIGS. 10A-10C (collectively referred to as FIG. 10) depict another exemplary embodiment of a formation production system.
Figure 10B:
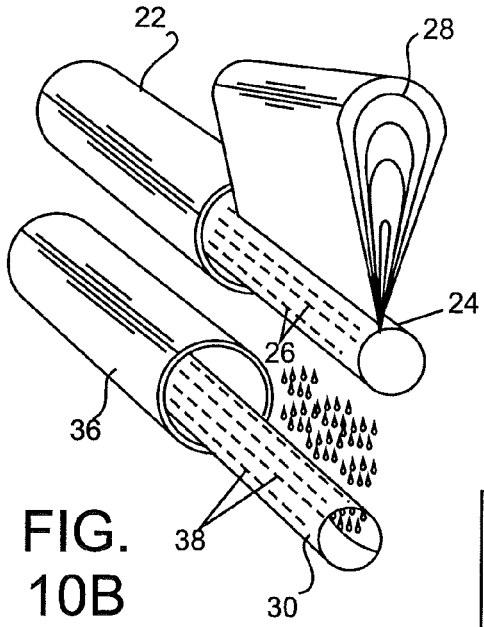
Figure 10C:
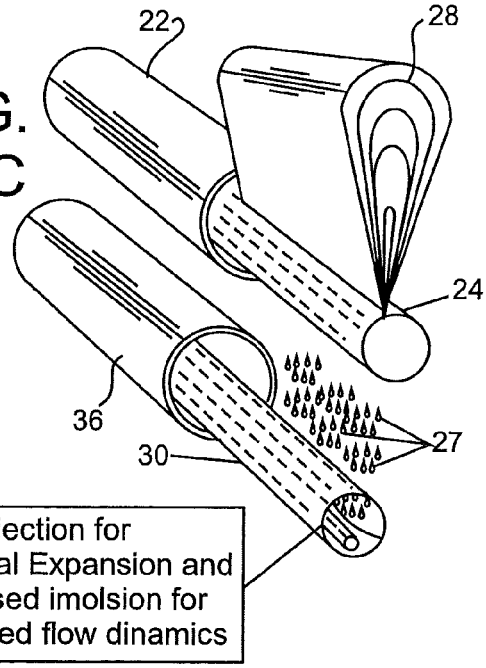

Referring to FIG. 10, an embodiment of the formation production system 10 includes the injection assembly 18 including the injector 24, and the production assembly 32 including the collector 30. In this embodiment, the production assembly includes a thermal injection conduit 132 disposed and extending through the production conduit 36 and extending through an interior of the collector 30. The thermal injection conduit 132 is connected to a surface source of thermal energy, such as steam, a heated gas or a fluid, and acts to maintain selected thermal characteristics of the bitumen 27 as it is recovered, such as maintaining a desired viscosity. In one embodiment, the thermal injection conduit 132 is a flexible tubing. The thermal injection conduit 132 is configured to exert thermal energy over an entirety or a selected portion of its length. In one embodiment, the thermal injection conduit 132 is impermeable to the source of thermal energy.

The embodiment of FIG. 10 provides numerous advantages relative to prior art production systems. Prior art production systems require high temperatures and pressures of injected steam to maintain the bitumen at a desired viscosity during recovery. Because a selected temperature of the bitumen 27 can be regulated in the production side in the embodiment described herein, less energy (i.e., lower temperatures and/or pressures) need be applied through the injection side, and thus the production system 10 can be successfully utilized more efficiently and with less energy than prior art systems. Furthermore, the flow characteristics of the bitumen can be increased relative to prior art systems.

Figure 11:
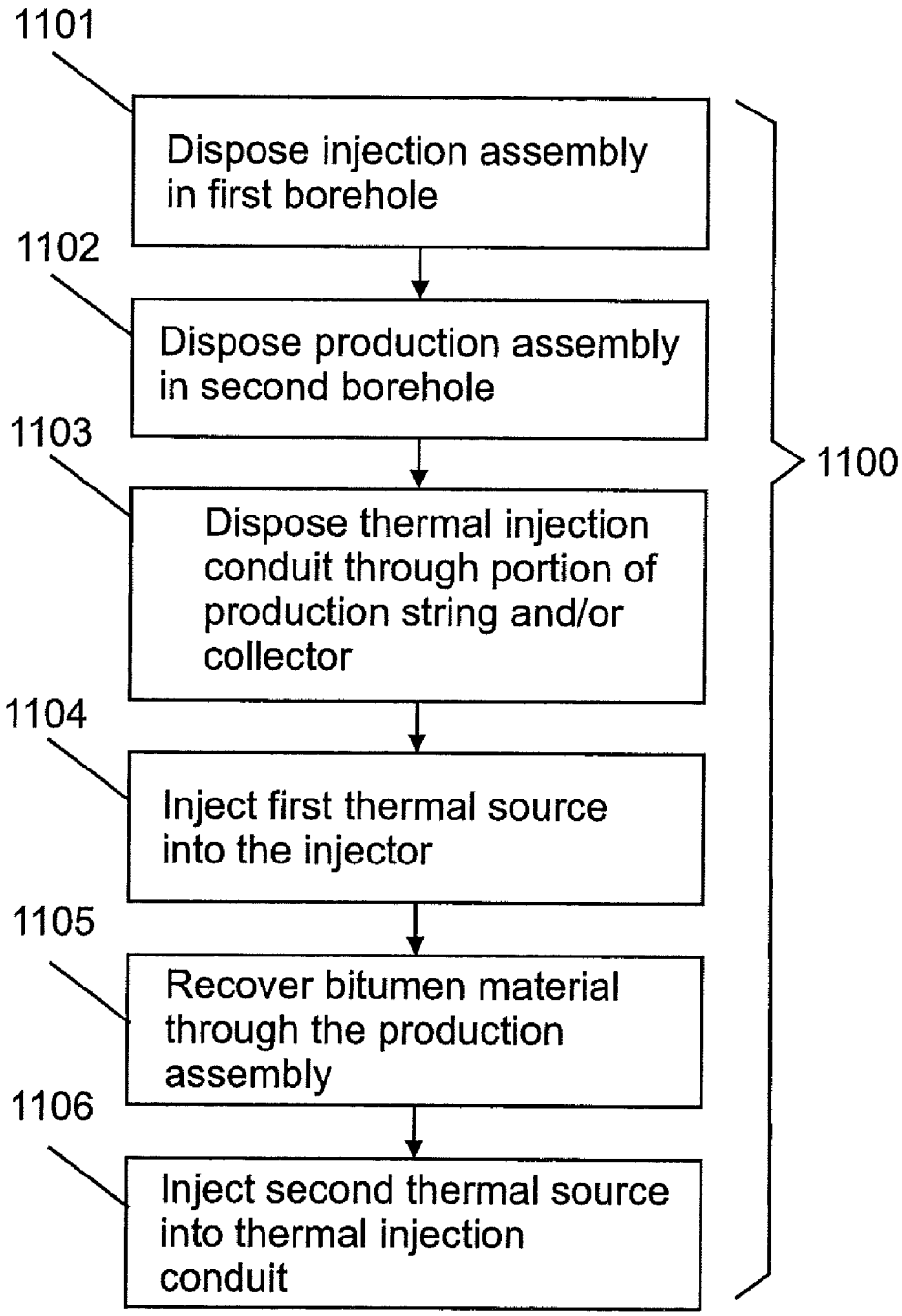
FIG. 11 depicts a flow chart providing an exemplary method of producing petroleum from an earth formation.

FIG. 11 illustrates a method 1100 of producing petroleum from an earth formation. The method 1100 includes one or more stages 1101-1106. In one embodiment, the method 1100 includes the execution of all of stages 1101-1106 in the order described. However, certain stages may be omitted, stages may be added, or the order of the stages changed. Although the method 1100 is described in conjunction with the production assembly 32, the method 1100 may be utilized in conjunction with any production system to regulate thermal characteristics of material produced from an earth formation.

In the first stage 1101, an injection assembly such as the injection assembly 18 is disposed in the first borehole 12, and advanced through the borehole 12 until the injector 24 is located at a selected location.

In the second stage 1102, a production assembly such as the production assembly 32 is disposed in the second borehole 14, and advance through the borehole 14 until a collector such as collector 30 is positioned at a selected location. In one embodiment, the selected location is directly below, along the direction of gravity, the injector 24.

In the third stage 1103, the thermal injection conduit 132 is disposed through at least a portion of the production string 114 and/or the collector 30. In one embodiment, the thermal injection conduit 132 is disposed in an interior of the production string 114 and the collector 30. In another embodiment, the thermal injection conduit 132 extends from a surface location to a distal end of the collector 30.

In the fourth stage 1104, a first thermal source such as steam is injected into the injector 24 to introduce thermal energy to a portion of the formation 16 and reduce a viscosity of the material therein, such as bitumen.

In the fifth stage 1105, the material migrates with the force of gravity and is recovered through the production string 114 and the collector 30.

In the sixth stage 1106, a second thermal source is injected into the thermal injection conduit 132 to regulate a thermal property of the material.

Figure 12B:
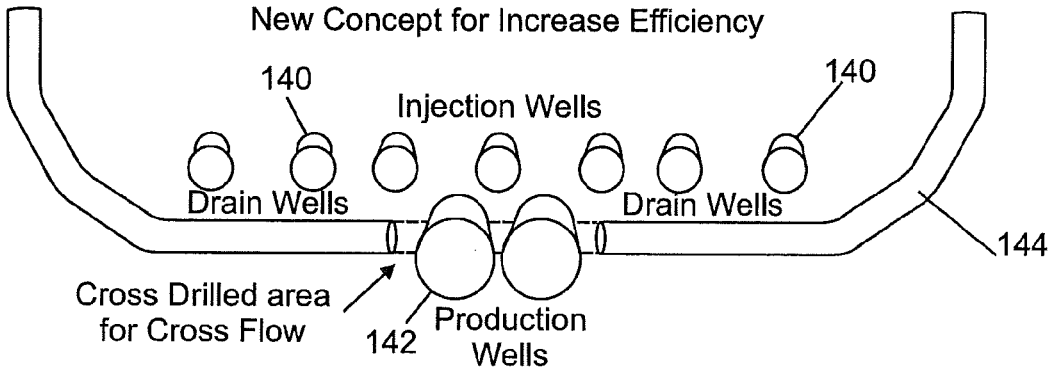
FIGS. 12A-12B (collectively referred to as 12) depict yet another exemplary embodiment of a formation production system.
Figure 12A:
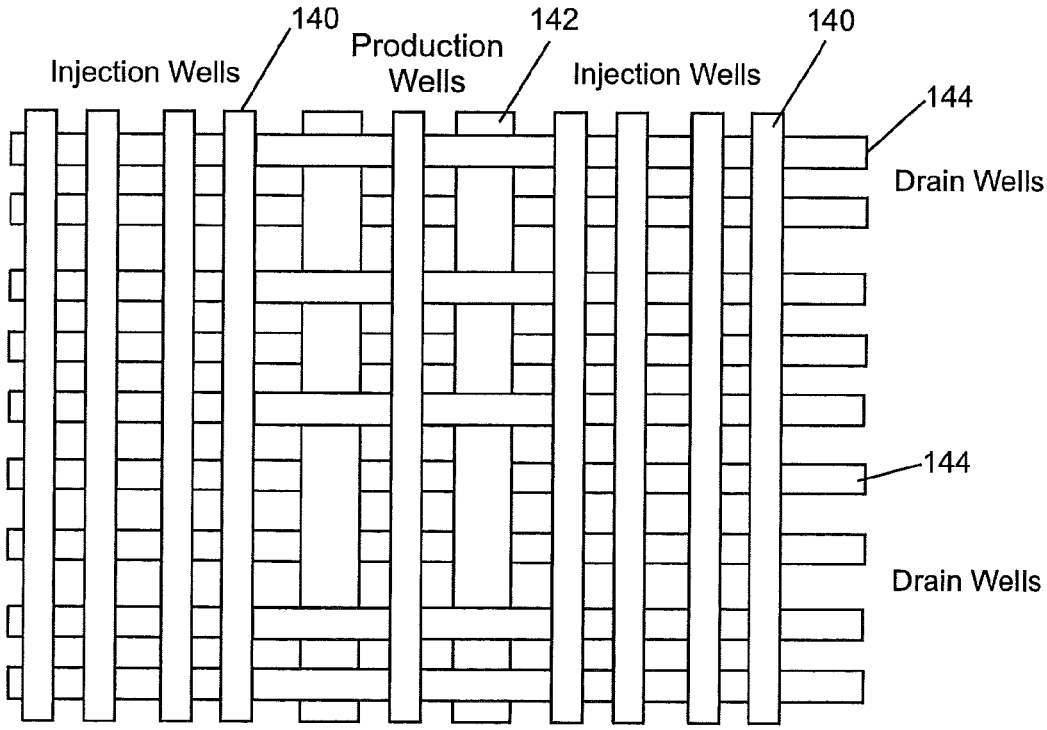

Referring to FIG. 12, an embodiment of a production system includes one or more injection boreholes 140 through which steam is introduced into the formation 16, one or more production boreholes 142 through which bitumen is recovered, and one or more drain boreholes 144. The numbers and configurations of boreholes 140, 142, 144 are exemplary, and may be adjusted as desired. In one embodiment, each production borehole 142 includes a pump such as an Electric Submersible Pump (ESP) pump. In one embodiment, each injection borehole 140 and production borehole 142 extends primarily in a vertical or azimuthal direction relative to the surface. In one embodiment, each drainage borehole 144 extends in a horizontal direction and at least partially intersects with the production boreholes. FIG. 13 illustrates a method 1300 of producing petroleum from an earth formation, which includes one or more stages 1301-1304. In one embodiment, the method 1300 includes the execution of all of stages 1301-1304 in the order described. However, certain stages may be omitted, stages may be added, or the order of the stages changed. Although the method 1300 is described in conjunction with the injection and production assemblies described herein, the method 1300 may be utilized in conjunction with any production system to regulate thermal characteristics of material produced from an earth formation.

In the first stage 1301, an injection assembly such as the injection assembly 18 is disposed in at least one injection borehole 140, and advanced through the injection borehole 140 until the injector 24 is located at a selected location.

In the second stage 1302, a production assembly such as the production assembly 32 is disposed in at least one production borehole 142, and advanced through the production borehole 142 until a collector such as collector 30 is positioned at a selected location. As discussed above, each production borehole 142 is at least partially intersected by the horizontal portion of the at least one drainage borehole 144, the at least one drainage borehole having a horizontal portion that at least partially intersects the production borehole;

In the third stage 1303, a first thermal source such as steam is injected into the injector 24 to introduce thermal energy to a portion of the formation 16 and reduce a viscosity of the material therein, such as bitumen.

In the fourth stage 1304, the material is recovered through the production assembly 32. In one embodiment, recovery is facilitated by pumping the material through the production assembly 32, for example, via an ESP, by gas lift, by natural steam lift and/or by any natural or artificial device for recovering the bitumen. In one embodiment, recovery includes inducing a flow of the material through the at least one drainage borehole 144 into the at least one production borehole 142 and/or exerting a pressure on the at least one production borehole 142. In one embodiment, recovery includes injecting additional materials such as steam, gas or liquid into the drainage boreholes 144 to facilitate recovery.

Figure 14:
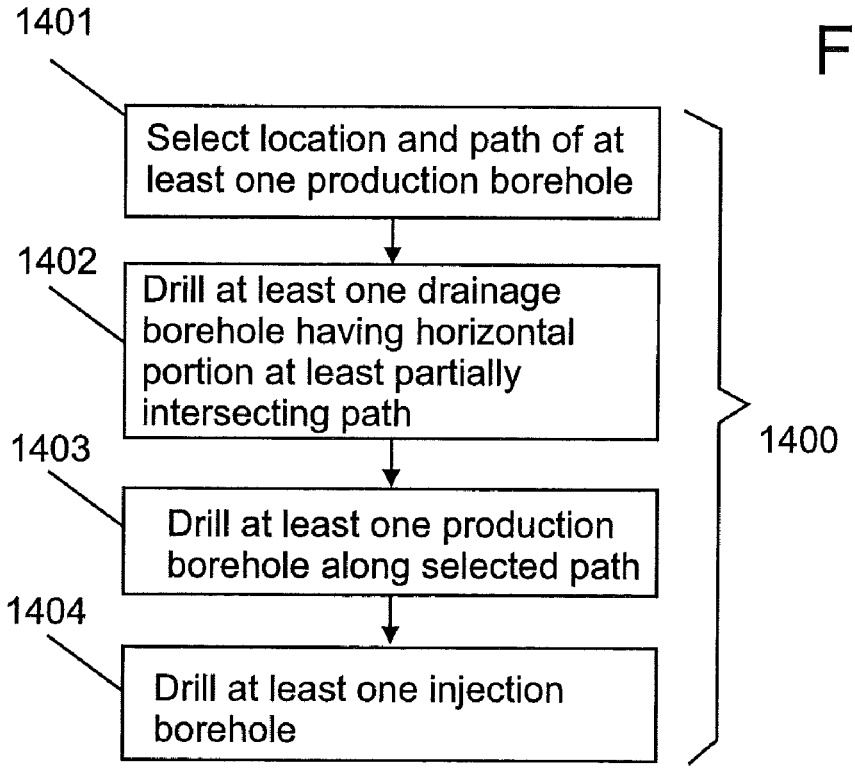
FIG. 14 depicts a flow chart providing an exemplary method of creating a petroleum production system.

FIG. 14 illustrates a method for creating the production system of FIG. 12, that includes one or more stages 1401-1404. In one embodiment, the method 1400 includes the execution of all of stages 1401-1404 in the order described. However, certain stages may be omitted, stages may be added, or the order of the stages changed. Although the method 1400 is described in conjunction with the injection and production assemblies described herein, the method 1400 may be utilized in conjunction with any production system to regulate thermal characteristics of material produced from an earth formation.

In the first stage 1401, a location and path of at least one production borehole 142 is selected. In one embodiment, the path includes a vertical and/or azimuthal direction.

In the second stage 1402, one or more horizontal drainage boreholes 144 are drilled in a vertical or azimuthal array, in which at least a portion of each drainage borehole intersects an area to be defined by the production borehole(s) 142.

In the third stage 1403, the production borehole(s) 142 are drilled in a vertical and/or azimuthal direction. In one embodiment, the cross sectional area of each production borehole 142 is greater than a cross sectional area of drainage boreholes 144, and the production borehole(s) 142 are each drilled so that a portion of the production borehole 142 intersects with each drainage borehole 144.

In the fourth stage 1404, which may be performed at any time relative to the first and second stages, the injection borehole(s) 140 are drilled in a vertical and/or azimuthal direction at a selected location relative to the production borehole(s) 142 and the drainage boreholes 144. In one embodiment, the injection borehole(s) 140 are drilled in a path that does not intersect either the production borehole(s) 142 or the drainage borehole(s) 144. In addition, materials such as steam, gas or liquid, or monitoring devices, can be inserted into the drainage boreholes 144 to increase recovery efficiency and/or monitor the production borehole(s) 142.

The borehole configuration of FIG. 12 significantly increases the efficiency and performance of the production system, as thermal efficiency over a formation area is increased and a larger formation area can be heated. As a result, fewer injection boreholes 140 are required. In addition, sand containing bitumen is produced at the intersections of the production borehole(s) 142 and the drainage boreholes 144, and bitumen may flow toward each production borehole 142 through the drainage boreholes 144 which exerts a pressure and provides a column effect which aids in recovery of the bitumen through the production borehole(s) 142, which increases the recovery efficiency and reduces the number of pumps needed. In addition, observation wells are not required.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing aspects of the teachings herein. For example, a sample line, sample storage, sample chamber, sample exhaust, pump, piston, power supply (e.g., at least one of a generator, a remote supply and a battery), vacuum supply, pressure supply, refrigeration (i.e., cooling) unit or supply, heating component, motive force (such as a translational force, propulsional force or a rotational force), magnet, electromagnet, sensor, electrode, transmitter, receiver, transceiver, controller, optical unit, electrical unit or electromechanical unit may be included in support of the various aspects discussed herein or in support of other functions beyond this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system for monitoring a location of a borehole for production of petroleum from an earth formation, the system comprising:

an assembly including at least one of an injection conduit for injecting a thermal source into the formation and a production conduit for recovering material including the petroleum from the formation;

a guide conduit attached to at least a portion of the at least one of the injection conduit and the production conduit, the guide conduit extending in a direction at least substantially parallel to the at least one of the injection conduit and the production conduit; and a detection source conduit insertable through the guide conduit and configured to dispose therein a detection source for detecting a location of the assembly in the formation, the detection source including an elongated electrically conductive member extendable along at least a portion of the detection source conduit, at least one portion of the elongated member including an electrosensitive material, the electrosensitive material reactive to an electric current to change shape in response to the electric current to form an electromagnet at the portion.

2. The system of claim 1, wherein the detection source is a plurality of detection sources distributed at selected locations along a length of the detection source conduit.

3. The system of claim 1, wherein the detection source is selected from at least one of a magnetic source, a point of nuclear source, an electro-magnetic induction coil, an acoustical device, a transmitting device, and a well logging tool.

4. The system of claim 1, wherein the guide conduit is attached to the production conduit, and includes a stinger to connect the guide conduit to the production conduit, the guide conduit being connected to an energy source for injection into the guide conduit to facilitate flow of petroleum through the production conduit.

5. The system of claim 4, wherein the energy source is selected from at least one of a steam and a gas source.

6. The system of claim 4, further comprising a one-way valve disposed between the guide conduit and the production conduit.

7. The system of claim 1, wherein the guide conduit is a coil tubing material.

8. The system of claim 1, further comprising an exterior housing surrounding the portion of the at least one of the injection conduit and the production conduit and a portion of the guide conduit.

9. The system of claim 8, wherein the exterior housing is configured to maintain the guide conduit and the at least one of the injection conduit and the production conduit in fixed position relative to each other.

10. The system of claim 9, wherein the exterior housing is configured to function as a packer to attach the exterior housing to a first location in a string conduit disposed in the borehole.

11. The system of claim 10, wherein the exterior housing is attached to the string conduit by a plurality of slips.

12. The system of claim 11, further comprising a second packer disposed in the string conduit and connected to the string conduit at a second location, the second packer being unattached to the string conduit.

13. The system of claim 1, wherein the electrosensitive material is configured to cause the elongated member to form a coil in response to the electric current, and the elongated member is configured to cause the coil to form a magnetic field in response to a selected electric current.

14. The system of claim 1, wherein the elongated member is a conductive cable, and the electrosensitive material is selected from at least one of an electrosensitive shape memory alloy and an electrically sensitive polymer.

15. A method of monitoring a location of a borehole for production of petroleum from an earth formation, the method comprising:

inserting a detection conduit through a guide conduit attached to at least a portion of at least one of an injection conduit and a production conduit in the borehole, the guide conduit extending in a direction at least substantially parallel to the at least one of the injection conduit and the production conduit;

disposing at least one detection source in the borehole via the detection conduit, the at least one detection source including an elongated electrically conductive member extendable along at least a portion of the detection conduit, at least one portion of the elongated member including an electrosensitive material, the electrosensitive material reactive to an electric current to change a shape of the electrosensitive material;

advancing the at least one detection source to a selected location;

activating the at least one detection source to emit a detection signal by applying an electric current to the at least one detection source and causing the electrosensitive material to change shape in response to the electric current to form an electromagnet; and detecting the detection signal to determine a location of the detection source.

16. The method of claim 15, wherein disposing includes hydraulically lowering the at least one detection source.

17. The method of claim 15, wherein the detection source is selected from at least one of a magnetic source, a point of nuclear source, an electro-magnetic induction coil, an acoustical device, a transmitting device, and a well logging tool.

18. The method of claim 15, wherein activating the at least one detection source includes applying a current to the elongated member to cause the electrosensitive material to change shape and cause the elongated member to form a coil, and forming an electromagnet at the portion responsive to the electric current.

* * * * *